US010406772B2

(12) United States Patent
Takahashi et al.

(10) Patent No.: US 10,406,772 B2
(45) Date of Patent: Sep. 10, 2019

(54) BINDING UNIT, SHEET PROCESSING DEVICE, AND IMAGE FORMING DEVICE PROVIDED WITH THEM

(71) Applicants: Masaya Takahashi, Misato (JP); Yusuke Mitsui, Misato (JP)

(72) Inventors: Masaya Takahashi, Misato (JP); Yusuke Mitsui, Misato (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/990,031

(22) Filed: May 25, 2018

(65) Prior Publication Data

US 2018/0339485 A1 Nov. 29, 2018

(30) Foreign Application Priority Data

| | | |
|---|---|---|
| May 26, 2017 | (JP) | 2017-104476 |
| May 26, 2017 | (JP) | 2017-104477 |
| May 26, 2017 | (JP) | 2017-104478 |
| Jun. 30, 2017 | (JP) | 2017-128935 |
| Jun. 30, 2017 | (JP) | 2017-128936 |

(51) Int. Cl.

| | |
|---|---|
| ***B31F 5/02*** | (2006.01) |
| ***B65H 37/04*** | (2006.01) |
| ***B42C 19/02*** | (2006.01) |
| ***B42C 1/12*** | (2006.01) |
| ***G03G 15/00*** | (2006.01) |
| *B42B 4/00* | (2006.01) |

(52) U.S. Cl.

CPC ..... *B31F 5/02* (2013.01); *B42C 1/12* (2013.01); *B42C 19/02* (2013.01); *B65H 37/04* (2013.01); *G03G 15/6544* (2013.01); *B42B 4/00* (2013.01); *B65H 2406/20* (2013.01); *B65H 2801/27* (2013.01)

(58) Field of Classification Search

CPC .. B31F 5/02; B42C 1/12; B42C 19/02; G03G 15/6544; B65H 37/04; B65H 2406/20; B42B 4/00

USPC ..... 412/9, 33

See application file for complete search history.

(56) References Cited

U.S. PATENT DOCUMENTS

2016/0041516 A1* 2/2016 Takashima ..... G03G 15/6541 412/33

FOREIGN PATENT DOCUMENTS

| | | | |
|---|---|---|---|
| JP | 3481300 | B2 | 10/2003 |
| JP | 3502204 | B2 | 12/2003 |
| JP | 2014-201432 | A | 10/2014 |
| JP | 2017-013930 | A | 1/2017 |

* cited by examiner

*Primary Examiner* — Justin V Lewis

(74) *Attorney, Agent, or Firm* — Manabu Kanesaka

(57) ABSTRACT

To facilitate permeation of water when water is applied to the crimping range of a sheet made of a water-permeable paper material. A binding unit applies water to placed sheets and then crimp-binds the sheets. The binding unit includes a pair of pressure teeth (pressure teeth and receiving teeth part) provided on both the front and back sides of the sheets and configured to crimp-binding the sheets, a water reservoir provided on the back surface side of any one of the pressure teeth and configured to store water to be applied to the sheet, and a pressurizing member (piston) that pressurizes the water in the water reservoir to apply water to the sheet crimping range.

14 Claims, 29 Drawing Sheets

BINDING UNIT, SHEET PROCESSING DEVICE, AND IMAGE FORMING DEVICE PROVIDED WITH THEM

RELATED APPLICATIONS

The present application is based on, and claims priorities from, Japanese Applications No. 2017-104476 filed May 26, 2017; No. 2017-104477 filed May 26, 2017; No. 2017-104478 filed May 26, 2017; No. 2017-128935 filed Jun. 30, 2017; and No. 2017-128936 filed Jun. 30, 2017, the disclosure of which is hereby incorporated by reference herein in its entirety.

BACKGROUND OF THE INVENTION

Field of the Invention

The present invention relates to a binding unit that applies binding processing to sheets, a sheet processing device, and an image forming device provided with them and, more particularly, to a binding unit or a sheet processing device that crimps and binds placed sheets after applying water to the sheet crimping range.

Description of the Related Art

Conventionally, an image forming device such as a copier, a printer, a facsimile device, and a compound machine thereof includes a sheet processing device. The sheet processing device has a binding unit that applies binding processing to a sheet bundle constituted by image-formed sheets placed onto a processing tray.

As such a binding unit, there is known a binding unit that crimps and binds sheets without use of a metal stapler needle that operates as a binding member for energy saving and environmental protection. In this so-called crimp-binding, a load is applied to a pair of pressure teeth each provided with projections and recesses with overlapped sheets interposed therebetween such that the projections and recesses mate with each other. As a result, fibers of the sheets are entangled with each other, whereby the sheets are fixedly bound together.

In this crimp-binding, the sheets can be bound without use of the staple needle; however, when the number of sheets to be bound is increased, the projections and recesses of the pressure teeth become less liable to mate with each other, with the result that fastening force between the pressure teeth is weakened.

For the purpose of increasing the fastening force, in Patent Document 1, a block of water is applied to the surface of a sheet bundle when the sheet bundle is crimped using an upper die (upper pressure teeth) having triangular projections and recesses and a lower die (lower pressure teeth) mating with the upper die (FIG. 1 of Patent Document 1). That is, when water is permeated into a sheet made of a paper material, fibers of the sheet are unfolded and become easy to be entangled with each other, resulting in an increase in bonding power among fibers.

Similarly, Patent Document 2 discloses a device that applies water to paper sheets before crimping the paper sheets so as to facilitate mutual entanglement of the fibers of the sheets. In this device, the water is fed along the edge of the sheet during conveyance of the sheet, so that the water can be fed to each sheet being conveyed (FIG. 2 of Patent Document 2).

Furthermore, Patent Document 3 discloses a device that applies water to a sheet binding area before performing crimp-binding. In this device, an inkjet head that ejects water from a nozzle hole is used as a water application means (FIG. 10 of Patent Document 3). Further, the disclosed device is configured to change crimping strength by changing the amount of water to be applied.

Further, in the device disclosed in Patent Document 4, crimping is done with masking performed to limit the water application range (particularly, FIG. 10 of Patent Document 4). When water is fed along the sheet edge as in the technique disclosed in Patent Document 2, the part of the sheet that is not subjected to crimp-binding becomes shabby due to the water feeding along the edge of the sheet, and thus finishing quality of the bound sheet bundle is deteriorated. Thus, the masking is performed so as to prevent this problem.

[Patent Document 1] Japanese Patent Gazette No. 3481300
[Patent Document 2] Japanese Patent Gazette No. 3502204
[Patent Document 3] Japanese Patent Application Publication No. 2014-201432
[Patent Document 4] Japanese Patent Application Publication No. 2017-013930

However, in Patent Document 1, water is fed from a tank through one water hole formed in the pressure teeth to form a block of water on the sheet surface by surface tension. This is not sufficient to permeate water into the sheet to such a degree that the fibers are unfolded.

Further, in Patent Document 2, water is applied to each sheet by a fabric-like belt. Like Patent Document 1, water is hardly permeated into the sheet to such a degree that fibers are unfolded.

In Patent Document 3, the inkjet head is used to apply water to a crimp-binding range. However, water needs to be applied to each sheet, and water still cannot be permeated sufficiently. In addition, in Patent Document 3, the inkjet head for water application needs to be moved to a sheet bundle and retracted therefrom, thus complicating the device configuration.

Further, in Patent Document 4, the inkjet head is used to apply water with masking performed to limit the water application range, and then crimping is performed. Thus, like Patent Document 4, water cannot be permeated into the sheet sufficiently, and the inkjet head needs to be moved to a sheet bundle and retracted therefrom.

SUMMARY OF THE INVENTION

The object of the present invention is to facilitate permeation of water when water is applied to the crimping range of a sheet made of a water-permeable paper material.

The present invention has the following configuration.

A binding unit is a unit that applies water to placed sheets and then crimp-binds the sheets, the unit including a pair of pressurizing parts provided on both the front and back sides of the sheets and configured to crimp-binding the sheets, a water reservoir provided on the back surface side of either one of the pressurizing parts and configured to store water to be applied to the sheet, and a pressurizing member that pressurizes the water in the water reservoir to apply the water to the sheet crimping range. The sheet mentioned in the present invention refers to a thin material into which water is permeated to unfold the fibers thereof. Further, the water mentioned in the present invention refers to a liquid having the same properties as those of water.

According to the present invention, water is pressurized to be applied to the crimping range of a sheet made of a water-permeable paper material, so that permeation of water into the sheets is facilitated, making it easy for the fibers of the sheets to be unfolded.

BRIEF DESCRIPTION OF THE DRAWINGS

FIGS. 4A and 4B are perspective views of the binding unit, in which FIG. 4A illustrates the back side of the binding unit and FIG. 4B illustrates the front side thereof;

FIGS. 5A and 5B are side views of the binding unit, in which FIG. 5A illustrates the binding unit as viewed from the rear side of the sheet processing device, and FIG. 5B illustrates the binding unit as viewed from the front side thereof;

FIGS. 6A and 6B are perspective views of the water application/pressurizing part of the binding unit, in which FIG. 6A is a perspective view from the side, and FIG. 6B is a perspective view from slightly above;

FIGS. 7A and 7B are cross-sectional views of the water application/pressurizing part of the binding unit, in which FIG. 7A is a front view, and FIG. 7B is a side view;

FIGS. 8A and 8B are perspective views for explaining a state where the water application/pressurizing part of the binding unit is compressed, in which FIG. 8A is a perspective view from slight above, and FIG. 8B is a perspective view from slightly below;

FIGS. 9A and 9B are cross-sectional views for explaining a state where the water application/pressurizing part of the binding unit is compressed, in which FIG. 9A is a cross-sectional front view, and FIG. 9B is a cross-sectional side view;

FIGS. 14A to 14C are views illustrating a state where the binding unit performs crimp-binding without water application as viewed from the front side, in which FIG. 14A illustrates a sheet receiving state, FIG. 14B illustrates a pressure contact state, and FIG. 14C illustrates a sheet crimping state;

FIGS. 15A to 15C are views illustrating a state where the binding unit performs crimp-binding without water application as viewed from the rear side, in which FIG. 15A illustrates a sheet receiving state, FIG. 15B illustrates a pressure contact state, and FIG. 15C illustrates a sheet crimping state;

FIGS. 16A to 16C are cross-sectional views illustrating a state where the binding unit performs crimp-binding without water application, in which FIG. 16A illustrates a sheet receiving state, FIG. 16B illustrates a pressure contact state, and FIG. 16C illustrates a sheet crimping state;

FIGS. 17A to 17C are views illustrating a state where the binding unit performs water application/crimp-binding as viewed from the front side, in which FIG. 17A illustrates a sheet receiving state, FIG. 17B illustrates a pressure contact state, and FIG. 17C illustrates a sheet crimping state;

FIGS. 18A to 18C are views illustrating a state where the binding unit performs water application/crimp-binding as viewed from the rear side, in which FIG. 18A illustrates a sheet receiving state, FIG. 18B illustrates a pressure contact state, and FIG. 18C illustrates a sheet crimping state;

FIGS. 19A to 19C are cross-sectional views illustrating a state where the binding unit performs water application/crimp-binding, in which FIG. 19A illustrates a sheet receiving state, FIG. 19B illustrates a pressure contact state, and FIG. 19C illustrates a sheet crimping state;

FIGS. 20A to 20C are views for explaining pressure teeth and receiving teeth of the water application/pressurizing part, in which FIG. 20A is a plan view of the pressure teeth, FIG. 20B is a cross-sectional view of the pressure teeth and receiving teeth, and FIG. 20C is a bottom view of the pressure teeth;

FIGS. 23A to 23C are views for explaining the relationship between the positions of the pressure teeth support part and receiving teeth support part and the position of sheets held between the pressure teeth support part and the receiving teeth support part, in which FIG. 23A is an explanatory view illustrating the state of FIG. 22 and FIGS. 23B and 23C are explanatory views each illustrating a configuration with a problem;

FIGS. 24A to 24D are views for explaining the relationship between the number of sheets placed on the processing tray and pressurization using pressure teeth/water application, in which FIG. 24A is a view for explaining the relationship between the pressure teeth and the number of sheets, FIG. 24B is a view for explaining a configuration where water application and crimping are performed for each of added sheets, FIG. 24C is a view for explaining a configuration where water application is performed for each of added sheets and crimping is performed after placement of the last sheet (after accumulation of certain number of added sheets), and FIG. 24D is a view for explaining a configuration in which water application and crimping are performed after placement of the last added sheet (after accumulation of a certain number of added sheets);

FIGS. 28A to 28F are views illustrating a modification (Modification 2) in which the position of a water supply hole (water supply tube) of the pressure teeth and the shape of the receiving teeth are changed, in which FIG. 28A illustrates a configuration in which the water supply holes are formed in respective ridges of the pressure teeth, FIG. 28B illustrates a configuration in which communication holes of the receiving teeth are each formed into a square shape in cross section, FIG. 28C illustrates a configuration in which the communication holes of the receiving teeth are formed in respective receiving ridges, FIG. 28D is a cross-sectional view of side view direction of FIG. 28A, FIG. 28E is a cross-sectional view of side view direction of FIG. 28B, and FIG. 28F is a cross-sectional view of side view direction of FIG. 28C; and FIGS. 29A and 29B are explanatory views illustrating a configuration in which an extension tank for increasing the capacity of the water replenishment tank is additionally installed, in which FIG. 29A illustrates a state where the amount of water in the extension tank is increased, and FIG. 29B illustrates a state where the amount of water in the extension tank is reduced.

DESCRIPTION OF THE PREFERRED EMBODIMENTS

Figure 1:
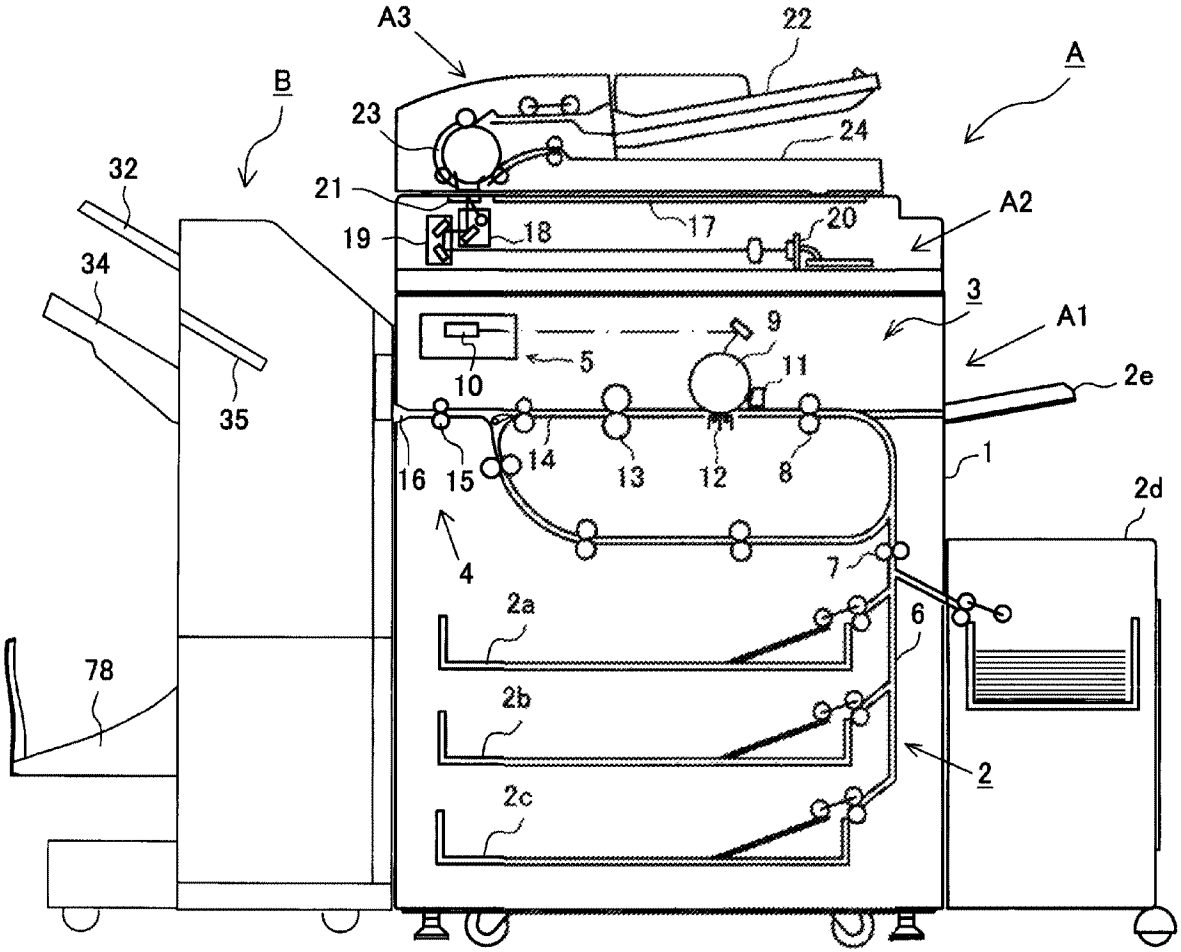
FIG. 1 is a view illustrating the entire configuration of a system having a combined structure of an image forming device and a sheet processing device according to the present invention.

Hereinafter, a preferred embodiment of the present invention will be described in detail with reference to the accompanying drawings. Throughout the description, the same reference numerals are given to the same or similar constituent elements.

[Image Forming Device]

An image forming device A illustrated in FIG. 1 will be described. The illustrated image forming device A is constituted of an image forming main body A1 and a sheet processing device (finisher) B. The image forming main body A1 is an electrostatic printing mechanism and constituted of a reading device A2 and a document conveying device A3. A device housing 1 of the image forming main body A1 incorporates therein a sheet supply section 2, an image forming section 3, a sheet discharge section 4, and a data processing section 5.

The sheet supply section 2 has cassettes 2*a* to 2*c* for storing sheets of different sizes to be image-formed and is configured to deliver sheets of a size specified through an image forming control section 200 and a sheet supply control section 202 to a sheet supply path 6. Thus, the plurality of cassettes 2*a* to 2*c* are detachably mounted in the device housing 1, and each cassette incorporates therein a separation mechanism for separating the stored sheets one from another and a sheet supply mechanism for delivering the sheets. The sheet supply path 6 is provided with a conveying roller 7 that conveys downstream the sheets fed from the plurality of cassettes 2*a* to 2*c* and a resist roller pair 8 that aligns the front ends of the sheets. The resist roller pair 8 is provided at the end portion of the sheet supply path 6.

The above sheet supply path 6 is connected with a large capacity cassette 2*d* and a manual feed tray 2*e*. The large capacity cassette 2*d* is an option unit that stores sheets of a size to be frequently used, and the manual feed tray 2*e* is configured to feed a special sheet hard to separately feed, such as a cardboard sheet, a coating sheet, and a film sheet.

The image forming section 3 is, for example, an electrostatic printing mechanism and includes a photoreceptor 9 (drum, belt) and a light emitter 10 for emitting an optical beam to the photoreceptor 9. Further, a developer 11 and a cleaner (not illustrated) are disposed around the rotating photoreceptor 9. The illustrated image forming section 3 is a monochrome printing mechanism, in which a latent image is optically formed on the photoreceptor 9 by the light emitter 10, and toner ink is deposited onto the latent image by the developer 11.

Then, a sheet is fed along the sheet supply path 6 to the image forming section 3 at the timing when an image is formed on the photoreceptor 9, the image on the photoreceptor 9 is transferred onto the sheet by a transfer charger 12, and the image is fixed to the sheet by a fixing unit (roller) 13 disposed on the sheet discharge path 14. On the sheet discharge path 14, there are provided a sheet discharge roller pair 15 and a main body sheet discharge port 16. The image-formed sheet is conveyed to the sheet processing device B to be described later.

The aforementioned reading device A2 is constituted of a platen 17 on which a document is placed, optical carriages 18 and 19 configured to be reciprocated along the platen 17, light sources mounted on the respective optical carriages 18 and 19, and a reduction optical system (combination of mirrors and lenses) that guides a reflected light from the document placed on the platen 17 to a photoelectric conversion member 20.

The reading device A2 further includes a traveling platen 21 as a second platen at the side of the platen 17. On the traveling platen 21, an image of a sheet document fed from the document conveying device A3 is read by the above optical carriages 18, 19 and the photoelectric conversion member 20. The photoelectric conversion member 20 electrically transfers image data obtained through photoelectric conversion to the mage forming section 3.

The document conveying device A3 is constituted of a document conveying path 23 that guides a sheet document fed from a document supply tray 22 to the traveling platen 21 and a document discharge tray 24 that stores a document whose image has been read on the traveling platen 21.

The image forming main body A1 is not limited to the above-described mechanism, and may be an offset printing mechanism, an inkjet printing mechanism, or an ink ribbon transfer (thermal transfer ribbon printing, sublimation ribbon printing, etc.).

[Sheet Processing Device]

The sheet processing device B receives, through an entrance 36, a sheet carried out from the main body sheet discharge port 16 of the image forming main body A1 and processes the sheet, and is called "finisher". The sheet processing device B has the following modes: (1) printout mode; (2) jog sorting mode; (3) binding mode; (4) bookbinding (saddle-stitching) mode; and (5) manual binding mode. Details of the above modes will be described later.

The sheet processing device B is not necessarily required to have all the abovementioned modes. The sheet processing device B may be appropriately arranged in accordance with device specifications (design specifications). The sheet processing device B disclosed herein includes a binding part B1 (end face binding part) that binds sheets at an end portion thereof from the front and back sides, a saddle-stitching part B2 that saddle-stitches sheets at a middle portion thereof in the sheet conveying direction, and an escape part B3 that does not perform binding but performs sorting and the like. As far as the present invention is concerned, it is required to provide a sheet loading/stacking configuration that once conveys sheets to a reference position for alignment before sheet binding.

Figure 2:
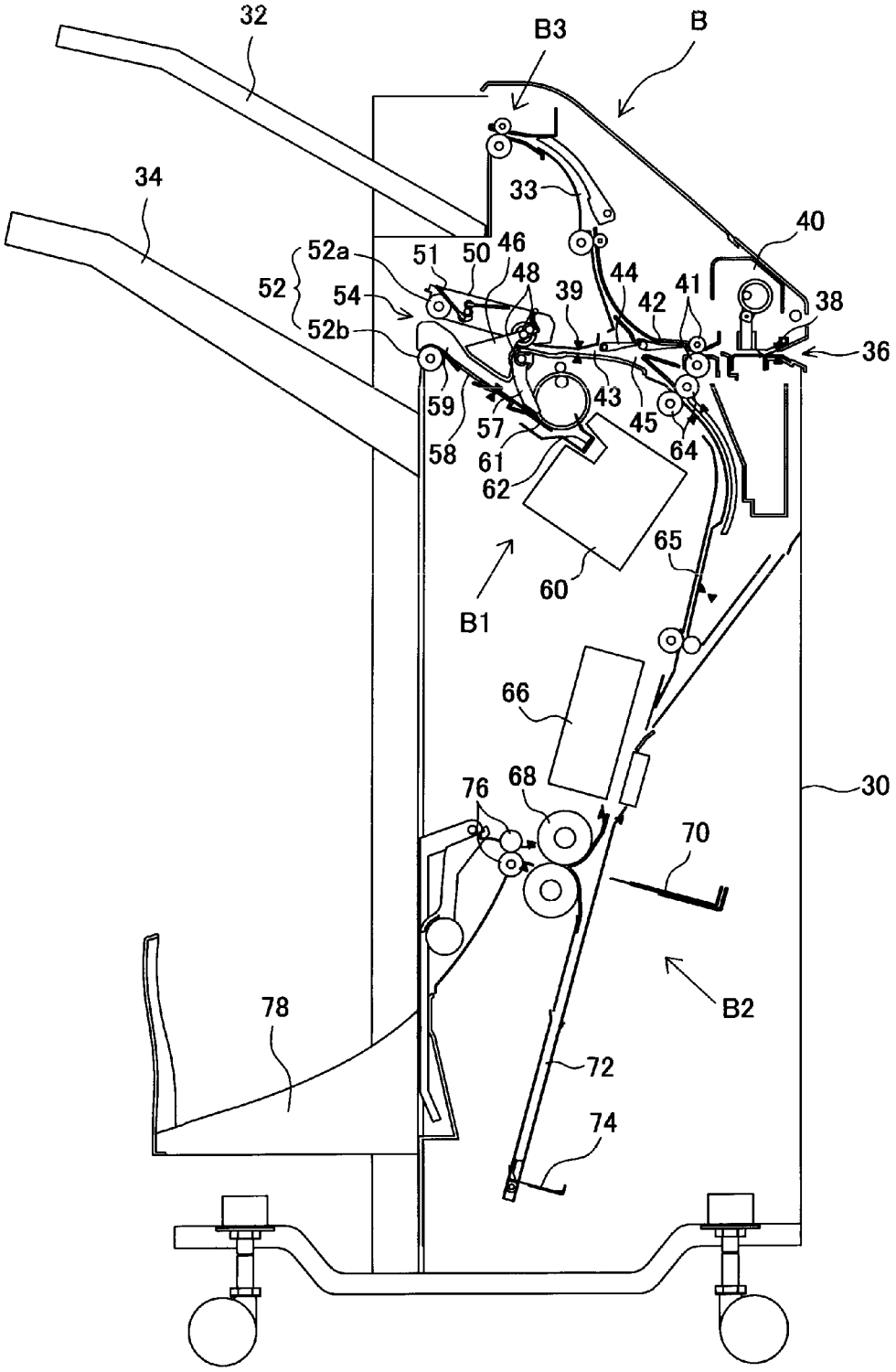
FIG. 2 is a view illustrating the entire configuration of the sheet processing device according to an embodiment of the present invention.

FIG. 2 illustrates the configuration of the sheet processing device B. The sheet processing device B has the sheet entrance 36 connected to the main body sheet discharge port 16 of the image forming device A. At the entrance 36, an entrance sensor 38 for detecting a sheet fed through the entrance 36 and a punch unit 40 that punches a sheet at an end portion thereof as needed are disposed. Below the punch unit 40, a punch chip box is detachably attached to a processing device frame 30. A carry-in roller 41 and a conveying roller 48 that convey a sheet to the downstream are provided at the rear of the punch unit 40.

A substantially linearly extending conveying path 43 along which a sheet is conveyed to a processing tray 58 side, an escape path 33 branched upward from the conveying path 43, and a saddle-stitching path 65 that guides a switched-back sheet passing through a merging part 45 of the conveying path 43 are provided downward of the carry-in roller 41. A sheet conveyed by the carry-in roller 41 is conveyed to the escape path 33 or the saddle-stitching path 65. This switching between the escape path 33 and saddle-stitching path 65 is made by first and second gates 42 and 44 provided in the middle of the conveying path 43.

[Escape Part]

A sheet conveyed substantially linearly along the conveying path 43 is accumulated in a loading tray 34 as a single sheet or a sheet bundle after once being loaded on the processing tray 58 or directly through a sheet discharge port 54. On the other hand, a sheet conveyed from the conveying path 43 to the escape path 33 provided above the conveying path 43 is accumulated in an escape tray 32. In this case, although not illustrated, a discharge roller at the last stage is configured to be moved at sheet discharge in a direction crossing the extending direction of the conveying path 43 for each specified number of sheets. This enables sorting jog of the escape part B3.

[Saddle-Stitching Part]

The conveying path 43 is provided with a sheet sensor 39 for detecting the rear end of a conveyed sheet. After detection by the sheet sensor 39, the conveying roller 48 is reversely rotated to convey the sheet to a branch roller 64. The branch roller 64 conveys the sheet along the saddle-stitching path 65, and the conveyed sheet is accumulated in a slightly inclined stacker 72 for saddle-stitching. A bundle of the accumulated sheets is positioned by upward movement of a saddle-stitching sheet stopper 74 such that the middle of the sheet bundle in the conveying direction corresponds to a binding position of a saddle-stitching unit 66.

The sheet bundle thus positioned is bound by the saddle-stitching unit 66 of the saddle-stitching part B2. The bound sheet bundle is then slightly lowered with its binding position aligned to a folding position and folded into two at the folding position by a folding blade 70 and a folding roller 68. The sheet bundle folded into two by the folding roller 68 is discharged to a bundle stacker 78 by a bundle discharge roller 76 and accumulated there as a saddle-stitched book. As described above, the escape part B3 and saddle-stitching part B2 are positioned above and below the conveying path 43, respectively.

[End Face Binding Part (Processing Tray and its Peripheral Members)]

The end face binding part B1 is constituted of the processing tray 58 and a (water application/crimp)-binding unit 60. The processing tray 58 on which a sheet is temporarily placed is positioned with a level difference from the exit of the conveying roller 48 so as to process a sheet conveyed from the conveying path 43 to the conveying roller 48. A drop-in guide 46 is provided at the exit of the conveying roller 48. The drop-in guide 46 drops a sheet to the loading face of the processing tray 58 at the same time when the sheet is carried out from the conveying roller 48. A return paddle 51 having a fin-shaped elastic piece is positioned downstream of the drop-in guide 46 as a transfer member for switch-back transfer of a sheet in the processing tray 58.

A sheet discharge roller 52 is disposed on the side of the return paddle 51 where the loading tray 34 is located. The sheet discharge roller 52 is constituted of a turnable upper discharge roller 52*a* and a fixed lower discharge roller 52*b*. The sheet discharge roller 52 performs an operation to nip a sheet conveyed from the conveying roller 48 for conveyance to the loading tray 34, to nip a first sheet of the sheets to be stored in the processing tray 58 for switch-back conveyance, or to convey a sheet bundle loaded on the processing tray 58 to the loading tray 34. Further, in the sheet discharge roller 52 disclosed herein, the upper discharge roller 52*a* is rotated in the same direction as the return paddle 51 to assist conveyance of the sheet on the processing tray 58 at the time of the switch-back conveyance.

Figure 3:
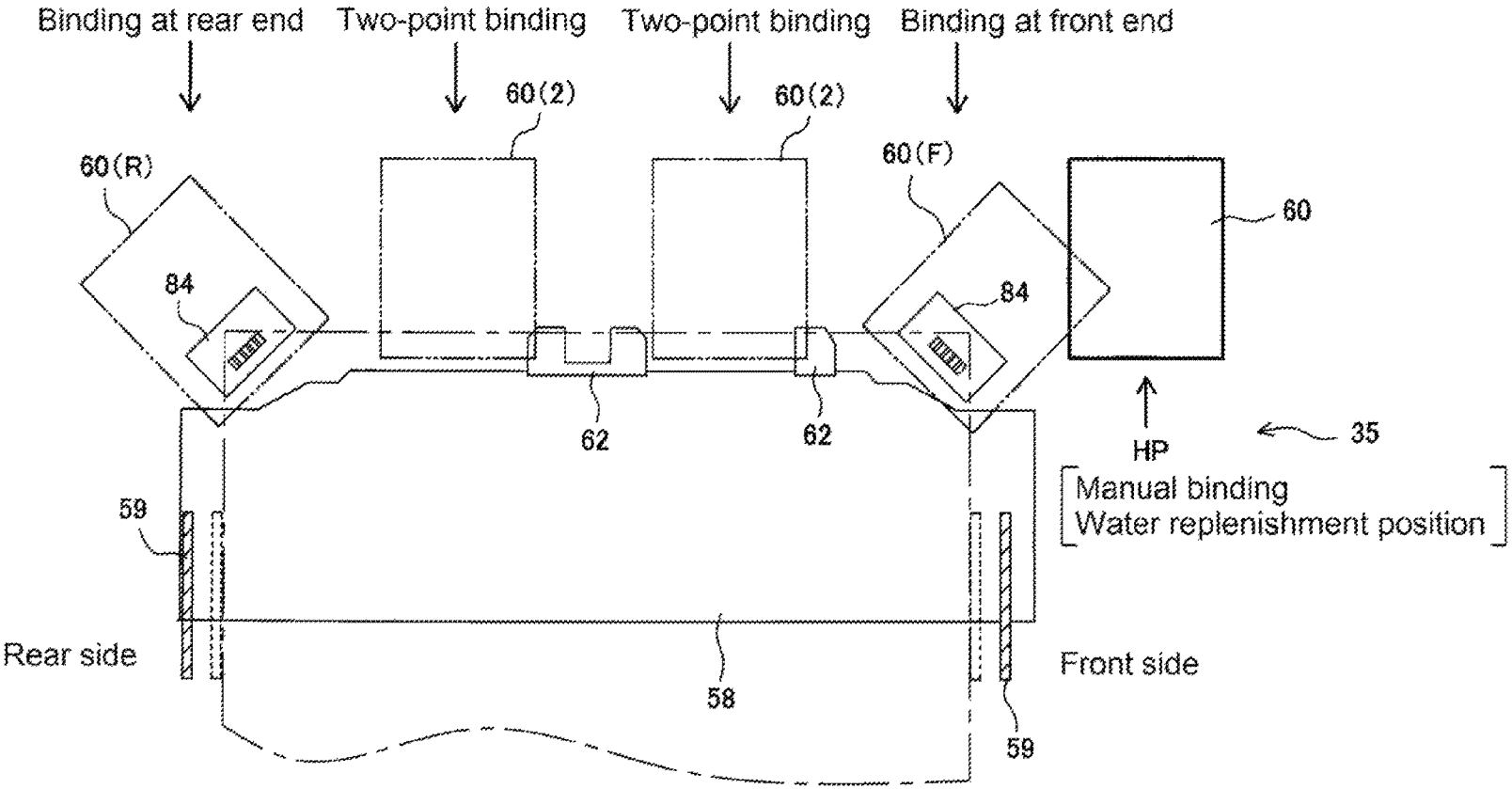
FIG. 3 is a plan view of a processing tray and a binding unit.

As illustrated in FIG. 3, an aligning plate 59 configured to be moved in the sheet width direction crossing the sheet conveying direction every time a sheet is carried out from the conveying roller 48 is provided on the processing tray 58. The aligning plate 59 is positioned on both sides of a sheet in the sheet width direction so as to sandwich the sheet and is driven to move by an aligning plate motor 59M in such a direction that the distance between the both sides of the aligning plate 59 becomes small for alignment of the sheet in the width direction. The sheet discharge port 54 is formed at one end of the processing tray 58, and a reference stopper 62 is provided at the other end of the processing tray 58 obliquely downward of the sheet discharge port 54 so as to receive abutment of a sheet switch-back conveyed by the return paddle 51 and the like.

As illustrated in FIG. 2, a carry-in guide 57 for guiding a sheet being switch-back conveyed is provided between the return paddle 51 and the reference stopper 62. The carry-in guide 57 is turnably provided around the lower-side axis of the conveying roller 48 so as to be suspended therefrom by its own weight and guides carry-in of the sheet being switch-back conveyed. Further, there is provided a return belt 61 that further conveys the sheet conveyed by the return paddle 51 toward the reference stopper 62. Further, a binding unit 60 is provided at the end portions of the stacked sheets (sheet bundle) stopped by the reference stopper 62.

The binding unit 60 illustrated in FIGS. 2 and 3 adopts crimp-binding to bind sheets by crimping the sheets using pressure teeth without using a metal staple needle and further performs so-called a water application/crimp-binding of applying water to the sheets at crimping and binding them. The sheet mentioned in the present invention refers to a thin material into which water is permeated to unfold the fibers thereof. Further, the water mentioned in the present invention refers to a liquid having the same properties as those of water. Details of the water application/crimp-binding will be described later using FIGS. 4A and 4B and subsequent figures.

The binding unit 60 that can perform the aforementioned water application/crimp-binding is driven to move in the sheet width direction (between the front and the rear of the device) by a binding unit moving motor (not illustrated) and can bind a sheet bundle at a corner portion thereof or a plurality of positions around the center of the end portion. In the example of FIG. 3, the binding unit 60 can be moved to a rear side corner 60 (R) which is the far side from an operator of the sheet processing device B, two positions 60 (2) along the edge of the sheet in the width direction, and a front side corner 60 (F) which is the front side of the device B or the operator side.

Further, the binding unit 60 disclosed herein has a manual binding position at which a sheet bundle inserted through a bundle manual feed port of the device frame 30 is bound.

The manual binding position is located at the same position as a position at which a water replenishment tank 174 to be described later is replenished with water and a home position at which positioning of the initial position of the movement of the binding unit 60 is performed.

After completion of the binding of a sheet bundle by the binding unit 60, the bound sheet bundle is pushed by the reference stopper 62 to be moved to the middle of the processing tray 58. Thereafter, the upper discharge roller 52*a* is lowered during the pushing, and the bound sheet bundle is nipped by the upper and lower discharge rollers 52*a* and 52*b* and discharged toward the loading tray 34 through the sheet discharge port 54.

The loading tray 34 for accumulating a single sheet or a bound sheet bundle is provided below the sheet discharge port 54. To keep constant the height position of the upper surface of the sheets accumulated on the loading tray 34, the upper surface of the sheets is detected, and when a certain amount of sheets are accumulated, a loading tray motor 34M is driven to move the loading tray 34 to keep constant the height position of the upper surface of the sheets from the sheet discharge port 54.

[(Water Application/Crimp)-Binding Unit]

Figure 4A:
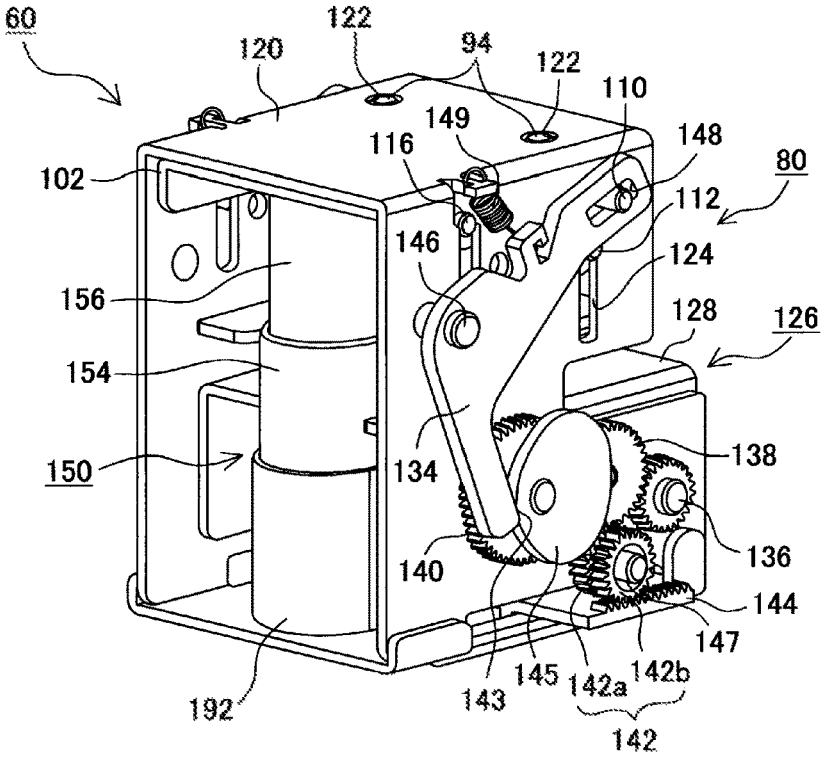
Figure 4B:
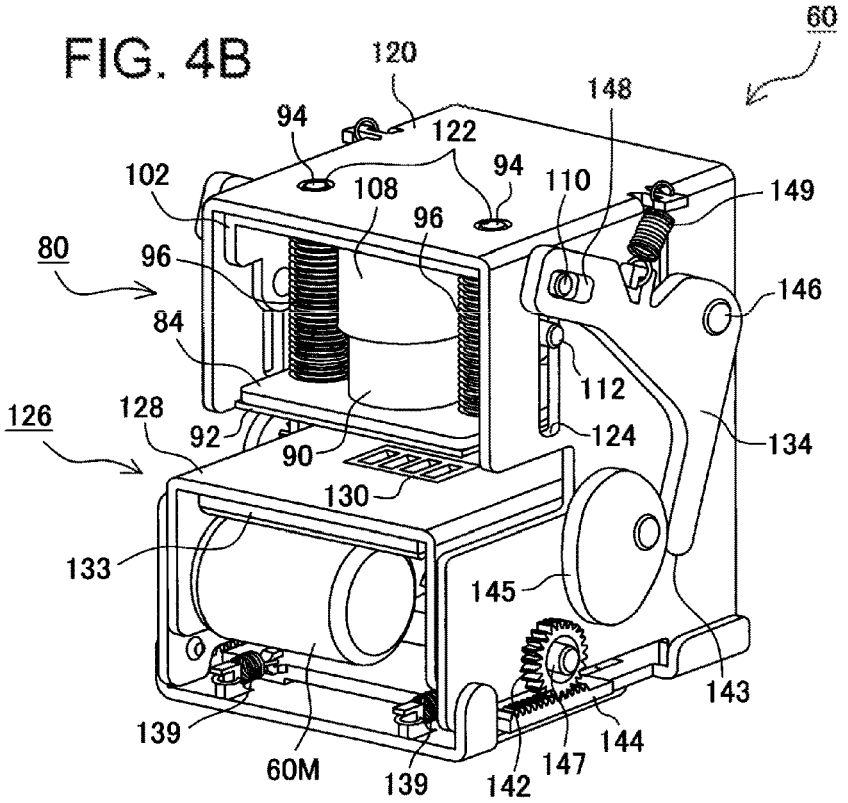
Figure 5A:
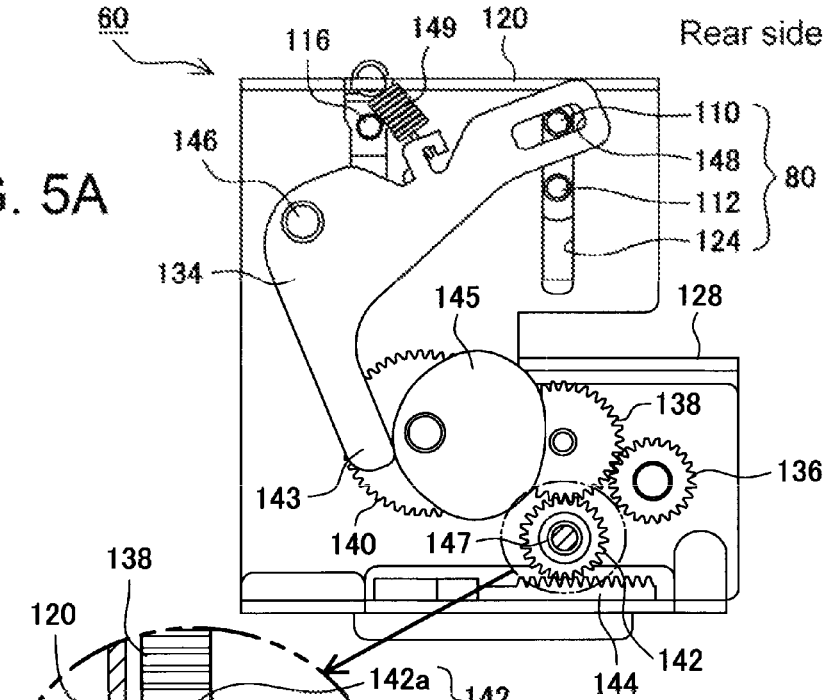
Figure 5B:
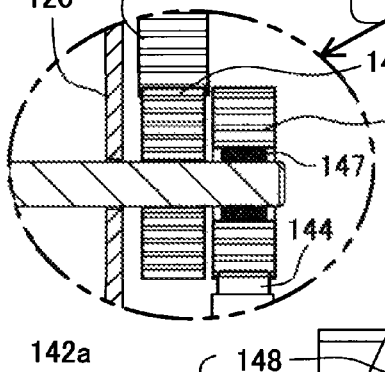
Figure 5B:
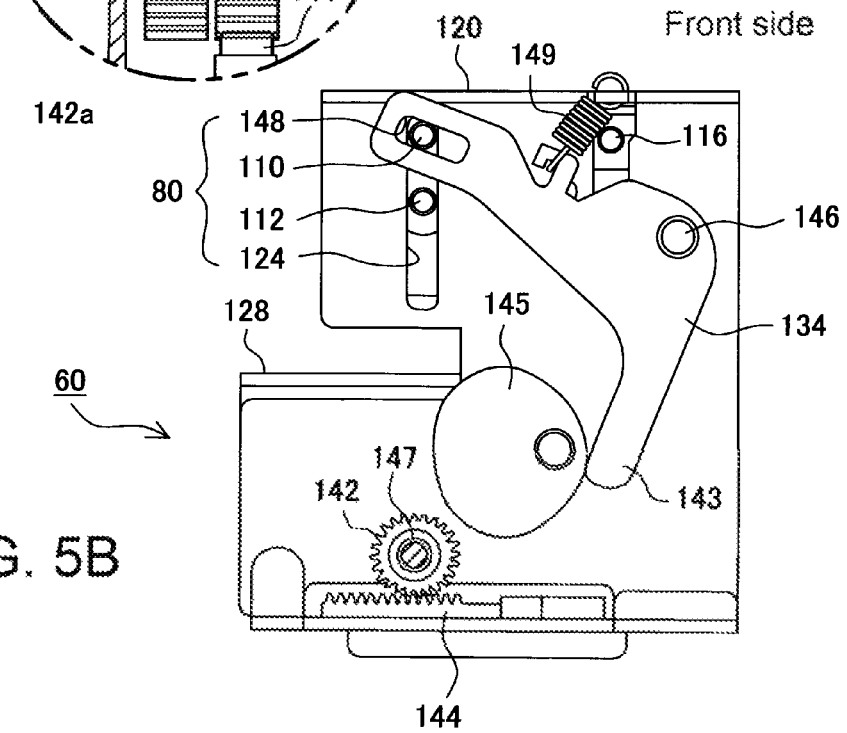

The following describes the binding unit 60 which characterizes the present invention with reference to FIGS. 4A and 4B and subsequent figures. At the binding unit 60, water is applied to the sheet binding position before crimping. FIGS. 4A and 4B are perspective views of the (water application/crimp)-binding unit 60. FIG. 4A illustrates the back side (the side remote from the operator) of the binding unit 60, and FIG. 4B illustrates the front side (the side near the operator) thereof. FIGS. 5A and 5B are side views of the binding unit 60. FIG. 5A illustrates the binding unit 60 as viewed from the rear side of the sheet processing device, and FIG. 5B illustrates the binding unit 60 as viewed from the front side thereof.

As illustrated in FIGS. 4A to 5B, the binding unit 60 is constituted of a water application/pressurizing part 80, a receiving teeth part 126, and a water replenishment pump part (pump unit) 150. The water application/pressurizing part 80 is configured to apply water to a sheet and has pressure teeth 82 (one of a pair of pressure teeth) configured to be vertically movable. The receiving teeth part 126 has receiving teeth 130. The water replenishment pump part 150 is provided for water replenishment to the water application/pressurizing part 80. The pressure teeth 82 (upper-side teeth) are provided on a pressure teeth support part 84 and is surrounded by an elastic member 92 such as a rubber plate.

The receiving teeth 130 which is the other one (lower-side teeth) of the pair of teeth are supported by a receiving teeth support part 128 to constitute the receiving teeth part 126. Sheets (sheet bundle) placed on the processing tray 58 are sandwiched between the pressure teeth 82 and the receiving teeth 130.

As illustrated in FIG. 4B, a cylinder 90 constituting a water reservoir 88 for retaining water to be applied to sheets is disposed on the back side of the pressure teeth 82, and a cylinder guide 108 is positioned radially outside a piston 104 to be described later. The piston 104 and cylinder 90 constitute a pressurizing member (water application member) for water application.

The receiving teeth 130 are supported by the receiving teeth support part 128, and the receiving teeth support part 128 also supports the lower surface of a sheet. Further, a drain pan 133 for receiving water remaining at water application is disposed below the receiving teeth support part 128.

Further, as illustrated in FIG. 4A, the water replenishment pump unit 150 serving as a water replenishment pump part that replenishes the water reservoir 88 with water is housed in an outer frame 120 of the binding unit 60 so as to be adjacent to the rear side of the pressure teeth 82 and receiving teeth 130. While the details will be described later, the water replenishment pump unit 150 is constituted of a water replenishment piston part 154 that supplies water to the water reservoir 88, a water replenishment head part 156 that moves the water replenishment piston part 154, and a water replenishment tank part 152 having a water replenishment tank 174 for storing water for replenishment. In FIG. 4A, a pump holding cover 192 that covers the water replenishment tank 174 can be seen.

A compression spring 96 is provided at the left and right of the cylinder 90 constituting the water reservoir 88 so as to be vertically sandwiched between the pressure teeth support part 84 that supports the pressure teeth 82 and the elastic member (rubber plate) 92 and a pressing plate 102 that moves up and down the pressure teeth 82.

[Vertical Movement of Pressing Plate]

The pressing plate 102 is driven by a drive motor (binding motor 60M) disposed in a space defined by the receiving teeth support part 128 and the outer frame 120 in the following manner. That is, as illustrated in FIGS. 4A and 5A, an intermediate gear 138 is engaged with a motor output shaft gear 136 mounted to the output shaft of the binding motor 60M as the drive motor on the rear side outer frame 120.

The torque of the intermediate gear 138 is transmitted to a cam gear 140 that rotates a moving cam 145 and a pinion gear 142 that moves a support rack 144 to a position at which it supports a water replenishment tank bottom 175 and to a position at which it does not. The pinion gear 142 is constituted of a pinion gear 142*a* that receives transmission of the torque from the intermediate gear 138 to be rotated together with its shaft and a pinion gear 142*b* that transmits the torque to the support rack 144 through a one-way clutch 147 with the shaft. With this configuration, whether or not to move the support rack 144 is selected depending on the rotation direction of the drive motor 60M. As a result, the water replenishment piston part 154 is operated only when required. Details of this mechanism will be described later.

The moving cam 145 is provided on both sides (front and rear sides) of the outer frame 120. Thus, a turning arm 134 moved by the moving cam 145 is mounted to the both sides of the outer frame 120 so as to be turned about an arm fulcrum 146 mounted to the outer frame 120. The turning arm 134 is kept in a state where an arm rear end 143 always abuts against the moving cam 145 by a return spring 149 stretched between the turning arm 134 and the outer frame 120.

On the other hand, an arm leading end slit 148 formed at the leading end of the turning arm 134 receives insertion of an upper moving pin 110 of the pressing plate 102. Thus, when the moving cam 145 is rotated, the leading end side of the turning arm 134 is vertically moved to vertically move the pressing plate 102. The upper moving pin 110 and a lower moving pin 112 of the pressing plate 102 are inserted into a guide slit 124 of the outer frame 120 on the front side (pressure teeth 82 side) of the pressing plate 102.

On the rear side (water replenishment pump unit 150 side) of the pressing plate 102 as well, a rear guide pin 116 of the pressing plate 102 is inserted into the guide slit 124 of the outer frame 120. Since the upper moving pin 110 is inserted into the arm leading end slit 148 of the turning arm 134, the pressing plate 102 can be vertically moved by turning of the turning arm 134. In this way, the pressing plate 102 and turning arm 134 constitute a moving member.

[Water Application/Pressurizing Part]

Figure 6A:
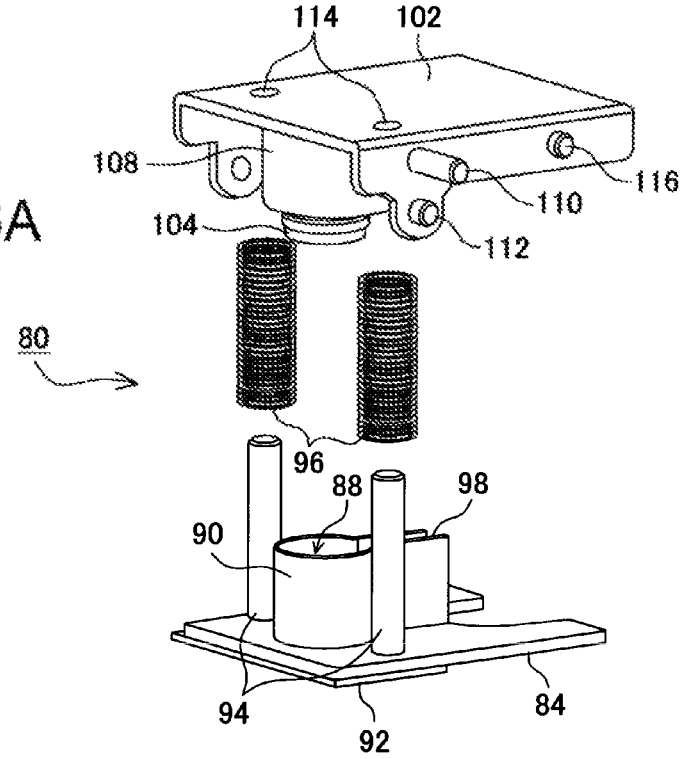
Figure 6B:
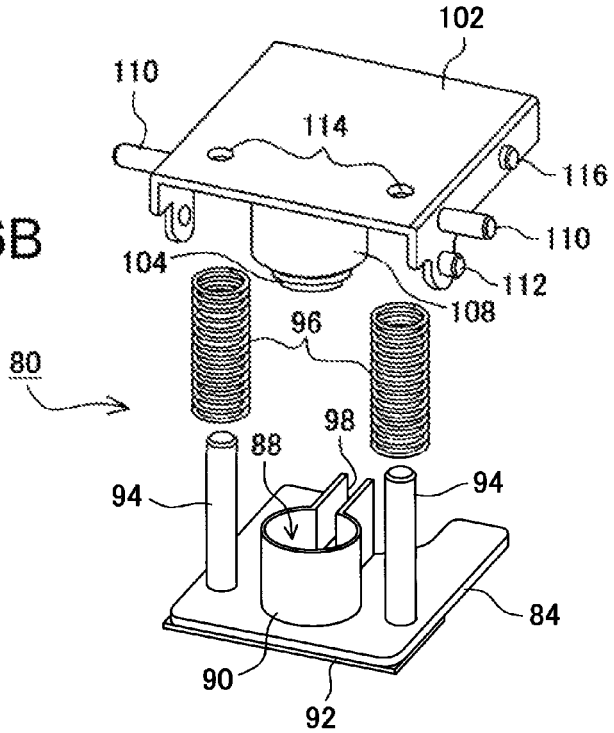
Figure 7A:
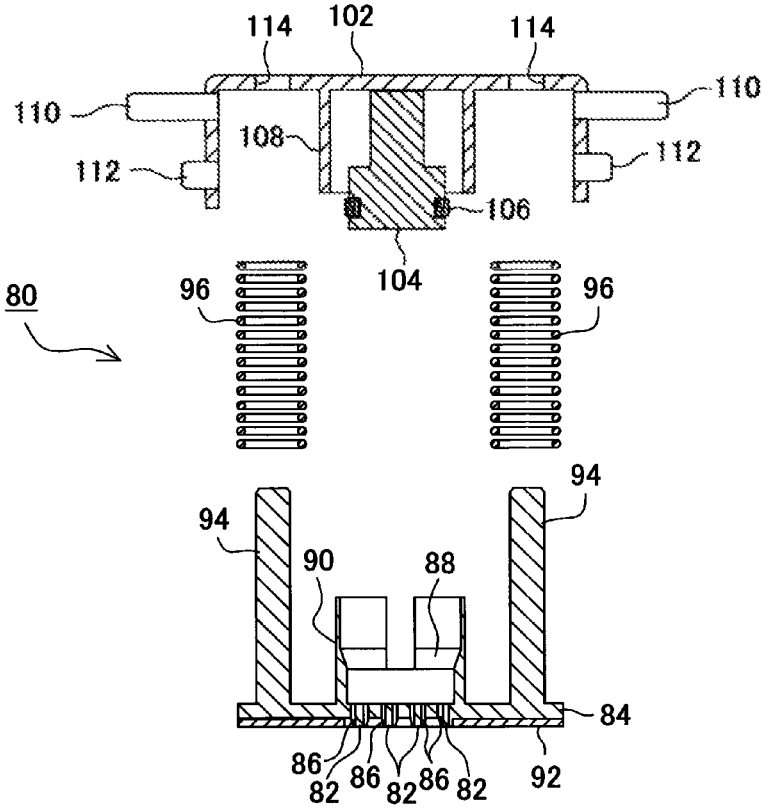
Figure 7B:
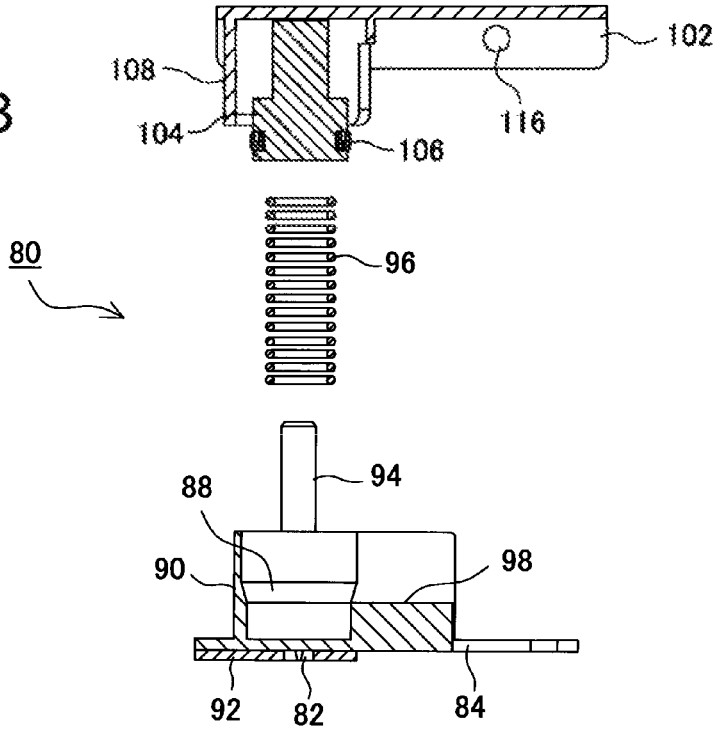

The pressing plate 102 vertically moves the water application/pressurizing part 80. This mechanism will be described with reference to FIGS. 6A to 9B. FIGS. 6A and 6B are perspective views of the water application/pressurizing part 80 of the binding unit 60. FIG. 6A is a perspective view from the side, and FIG. 6B is a perspective view from slightly above. FIGS. 7A and 7B are cross-sectional views of the water application/pressurizing part 80. FIG. 7A is a front view, and FIG. 7B is a side view.

The water application/pressurizing part 80 includes the pressing plate 102, the pressure teeth support part 84, and the compression spring 96 interposed between the pressing plate 102 and the pressure teeth support part 84. The pressure teeth 82 and the elastic member 92 (rubber plate) that surrounds the pressure teeth 82 are provided on the side of pressure teeth support part 84 that contacts a sheet. On the back surface side of the pressure teeth 82 (pressure teeth back surface side), the cylinder 90 integrally formed with the pressure teeth support part 84 and a guide bar 94 around which the compression spring 96 is wound are provided. The guide bar 94 is provided on both sides of the cylinder 90. The leading end of the guide bar 94 is kept fitted in a guide hole 114 of the pressing plate 102.

As illustrated in FIGS. 7A and 7B, the water reservoir 88 is formed in the cylinder 90. The water reservoir 88 occupies about one-third of the cylinder 90 in the height direction and retains water to be applied to sheets. Further, the cylinder 90 is cut to form a replenishment port 98 for receiving water from the water replenishment pump unit 150 to be described later. The illustrated cylinder 90 has the pressure teeth 82 formed integrally therewith, and water supply holes (water supply tubes) 86 are formed in the pressure teeth 82 so as to allow water in the water reservoir 88 to be applied to sheets.

The piston 104 is positioned above the cylinder 90. The piston 104 is configured to be inserted into the cylinder 90 to pressurize water in the water reservoir 88 so as to allow the water to be applied to sheets through the water supply holes 86 of the pressure teeth 82. The piston 104 is fixed to the pressing plate 102 at the upper end thereof. A piston packing 106 is circumferentially fitted to the insertion portion of the piston 104 into the cylinder 90. Although the piston packing 106 is fitted in one place in the example of FIGS. 7A and 7B, it may be fitted in two or more places, which increases pressurization at water application.

The pressing plate 102 has the cylinder guide 108 that is moved to overlap the cylinder 90 at a position radially outside thereof so as to facilitate insertion of the piston 104 and water application operation. The pressing plate 102 has the guide hole 114, the upper and lower moving pins 110 and 112 to be inserted into the guide slit 124 of the outer frame 120, and the rear guide pin 116. The upper and lower moving pins 110, 112, and the rear guide pin 116 are fixedly formed. The upper moving pin 110 extends outside slightly longer than other pins so as to allow insertion into the arm leading end slit 148 of the turning arm 134 turning outside the outer frame 120.

(Water Application/Pressurizing Part in Compressed State)

Figure 8A:
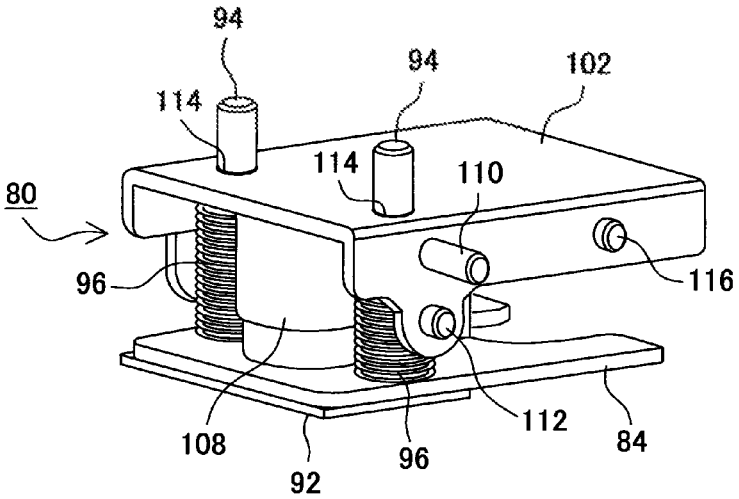
Figure 8B:
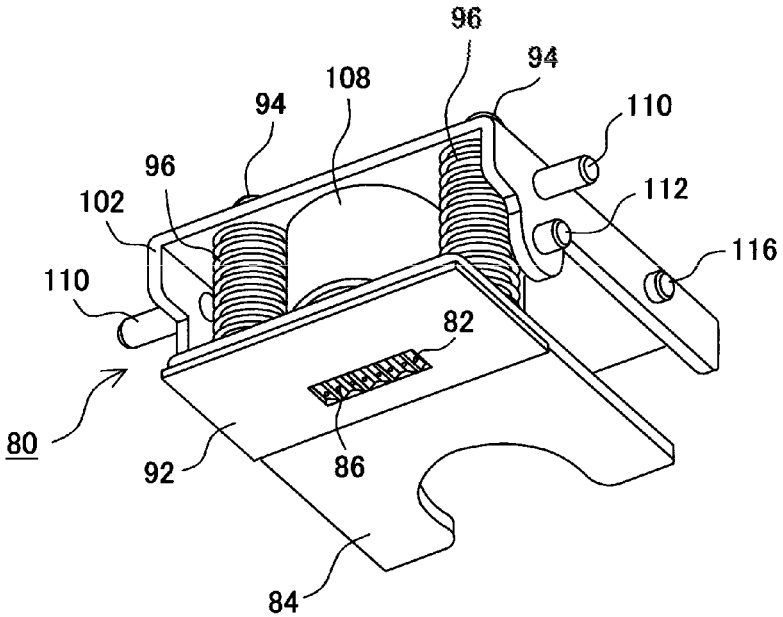
Figure 9A:
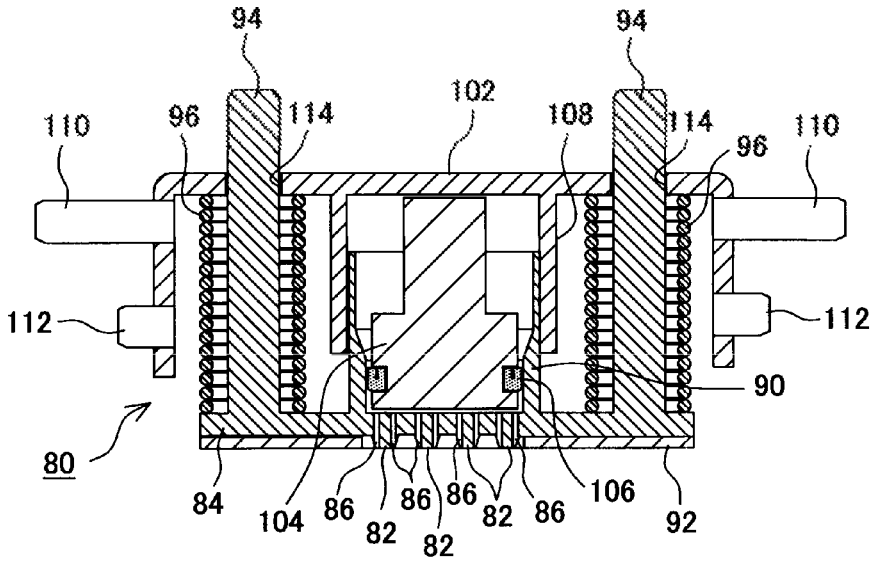
Figure 9B:
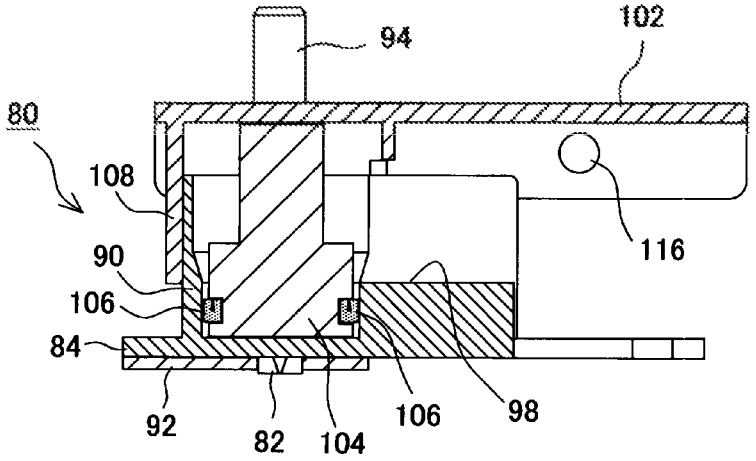

A state where the thus configured water application/pressurizing part 80 is compressed by the turning arm 134 is illustrated in FIGS. 8A and 9B. FIGS. 8A and 8B are perspective views of the water application/pressurizing part 80 from slightly above and below, respectively. The operation of the turning arm 134 that brings the water application/pressurizing part 80 into the compressed state will be described later using FIGS. 14A to 19C.

In the compressed state, the pressing plate 102 is made to abut against the receiving teeth support part 128 by the turning arm 134, the compression spring 96 wound around the guide bar 94 is compressed, and the guide bar 94 protrudes from the pressing plate 102 through the guide hole 114. As illustrated in FIG. 8B, which is a view illustrating this compressed state as viewed from the receiving teeth support part 128 side, the pressure teeth 82 having the water supply holes (water supply tubes) are surrounded by the elastic member 92 such as a rubber plate. That is, the pressure teeth support part 84 is pressed against a sheet bundle first, and then water in the water reservoir 88 is applied to the sheet bundle and, at this time, the elastic member prevents the water applied to an area other than the crimping range of the pressure teeth 82 from being spread.

FIGS. 9A and 9B are cross-sectional views of the water application/pressurizing part 80. FIG. 9A is a cross-sectional front view taken in a direction crossing both the cylinder 90 and the guide bar 94. FIG. 9B is a cross-sectional view taken in a direction perpendicular to that of FIG. 9A. As illustrated in FIGS. 9A and 9B, water retained in the water reservoir 88 formed in the cylinder 90 is applied to sheets through the water supply holes (water supply tubes) 86 of the pressure teeth 82 by the piston 104. In this state, the pressure teeth 82 receives force from the pressing plate 102 by the piston 104 and presses/crimps the water-applied sheets between themselves and the receiving teeth 130 mating with the pressure teeth 82.

The cylinder 90 is formed such that the inner diameter thereof is reduced downward, and as described above, the water reservoir 88 that retains water to be applied to sheets is formed so as to occupy about one-third of the cylinder 90 in the height direction. At this position, the water retained in the water reservoir 88 is pressurized by the piston 104 for water application. Above this position, water from the replenishment pump unit 150 is supplied to the water reservoir 88 through the replenishment port 98, followed by subsequent operation of the piston 104. Thus, the amount of water to be applied to sheets per one crimp-binding operation corresponds to the amount of water that can be retained in the water reservoir 88.

[Water Replenishment Pump Part]

The following describes the water replenishment pump unit 150 as the water replenishment pump part that replenishes the water reservoir 88 with water through the replenishment port 98 by referring to FIGS. 10 to 13. As already described using FIGS. 4A and 4B, the water replenishment pump unit 150 is inwardly installed in the outer frame 120 of the binding unit 60 like the pressure teeth support part 84 and the receiving teeth part 126. This eliminates the need to route water replenishment pipes from outside of the binding unit 60, facilitating the handling and making the device compact.

Figure 10:
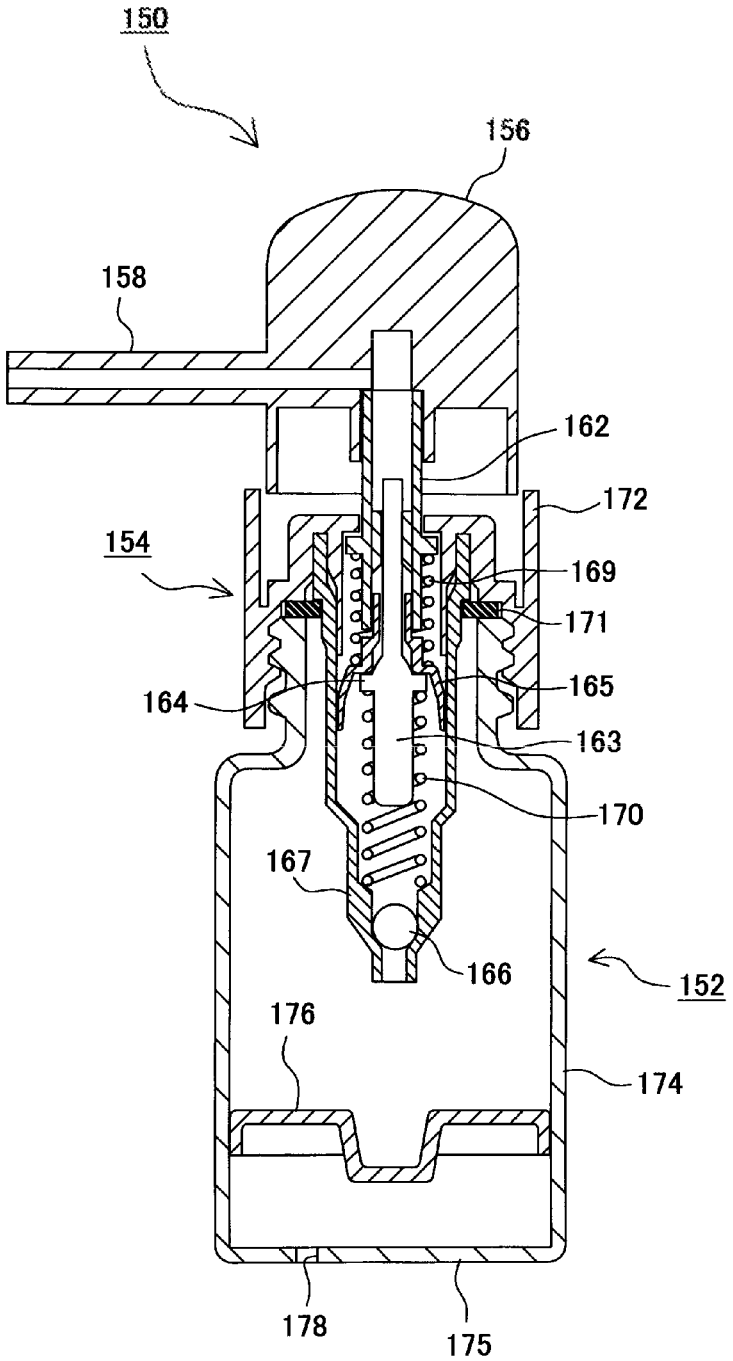
FIG. 10 is a cross-sectional view of a water replenishment pump unit.
Figure 11:
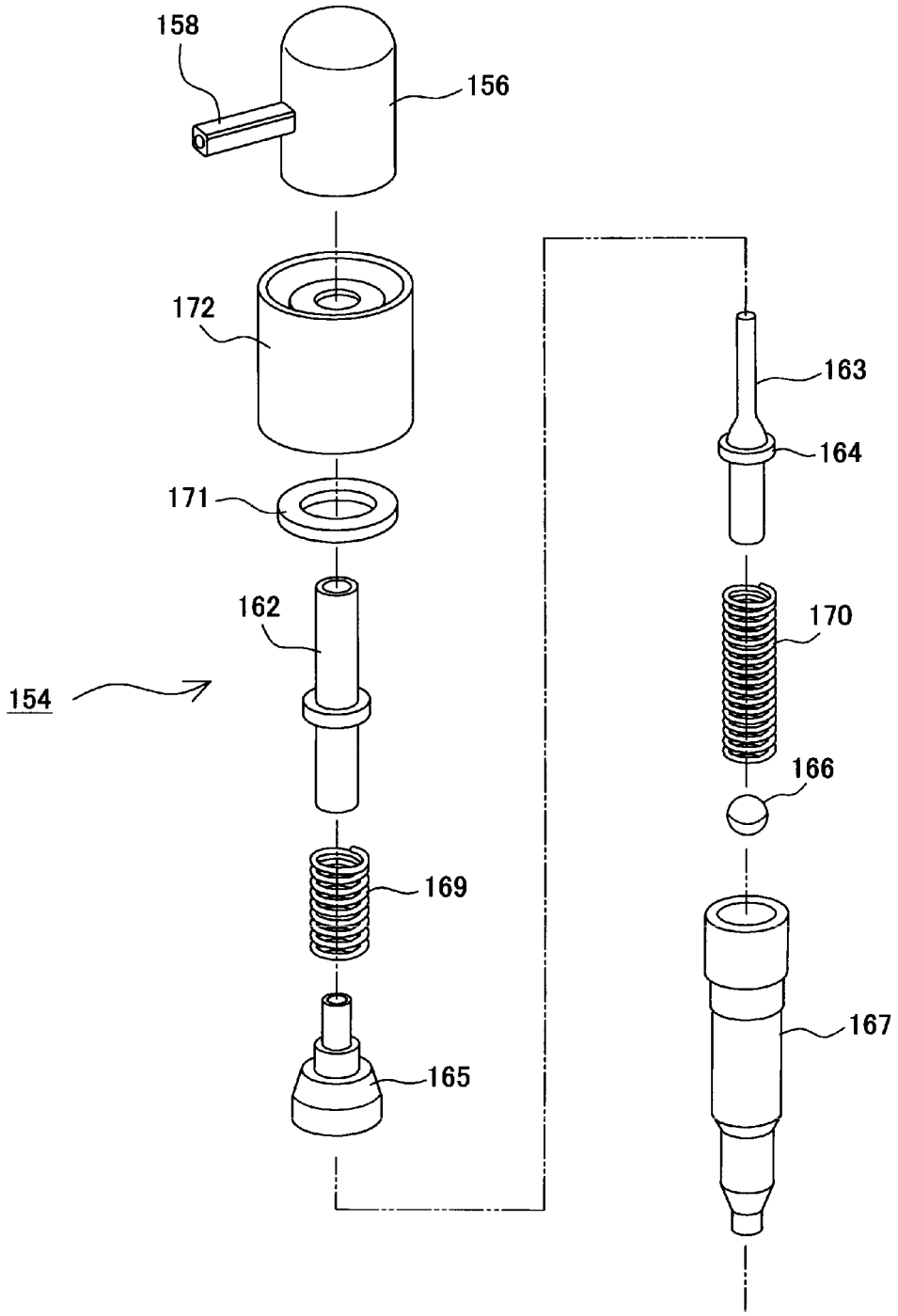
FIG. 11 is an exploded perspective view of the water replenishment piston part of the water replenishment pump unit.
Figure 12:
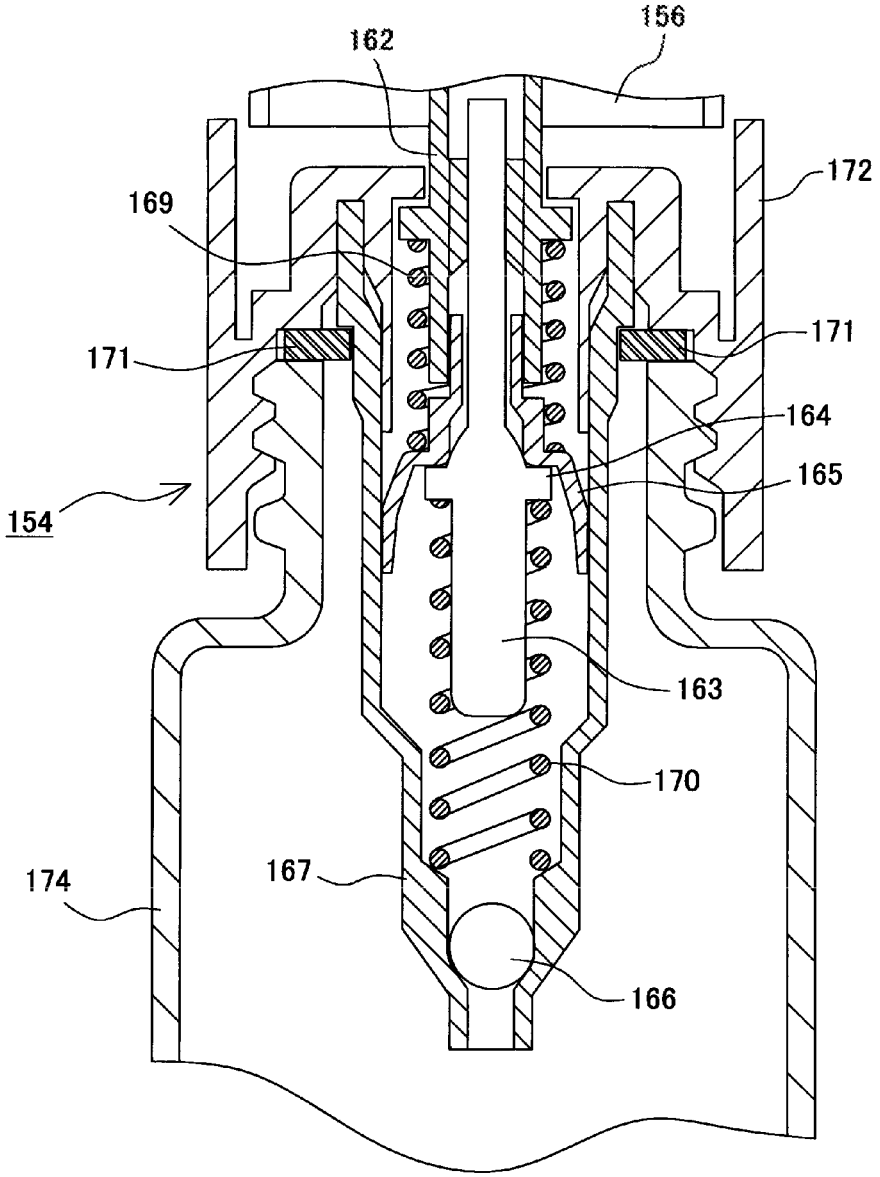
FIG. 12 is an enlarged view of the water replenishment piston part of the water replenishment pump unit.
Figure 13:
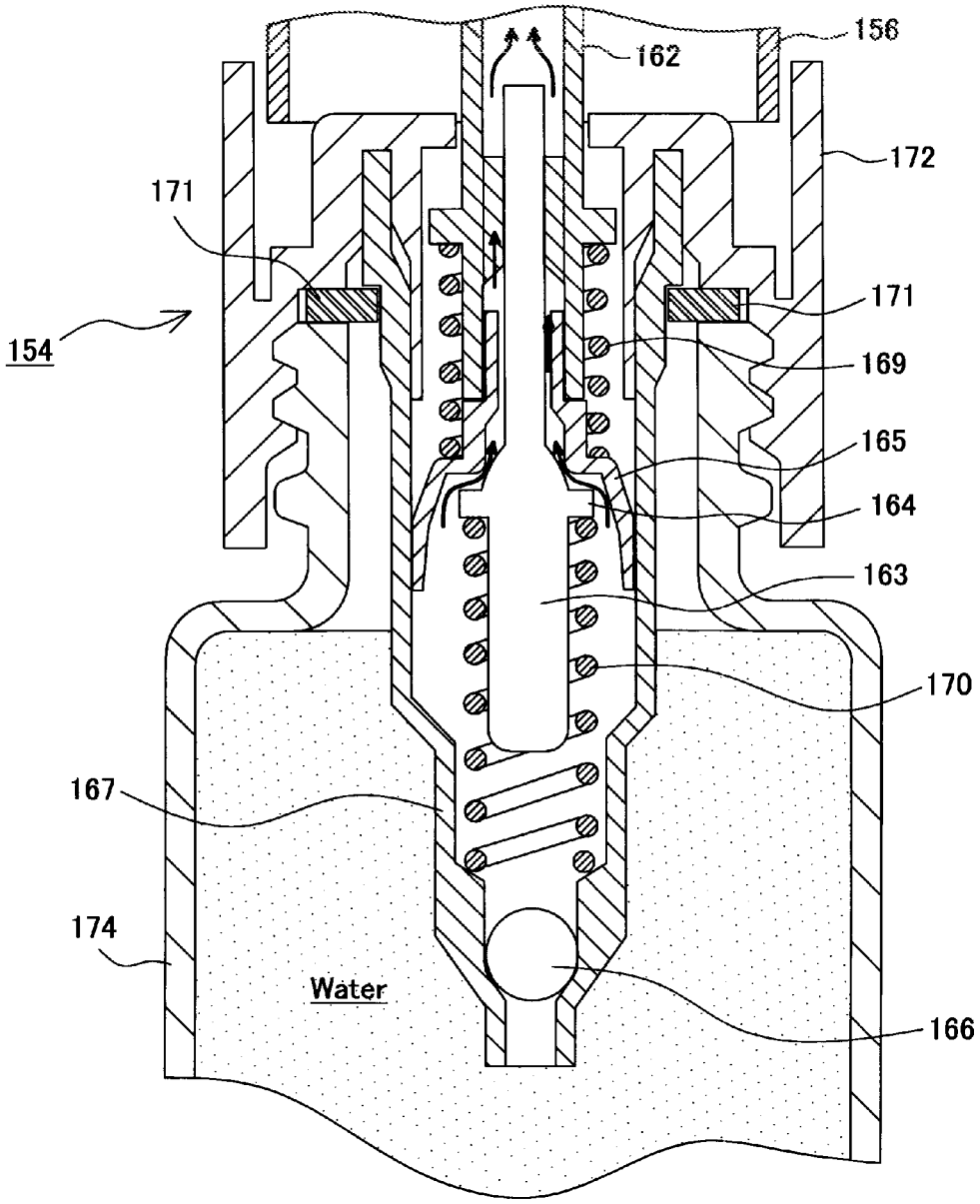
FIG. 13 is an enlarged view for explaining a state where water is ejected by the water replenishment piston part.

This water replenishment pump unit 150 will be described below with reference to the accompanying drawings. FIG. 10 is a cross-sectional view of the water replenishment pump unit 150. FIG. 11 is an exploded perspective view of the water replenishment piston part 154 which is an important constituent element of the water replenishment pump unit 150. FIG. 12 is an enlarged view of the water replenishment piston part 154. FIG. 13 is an enlarged view for explaining a state where water is ejected by the water replenishment piston part 154.

As illustrated in FIG. 10, the water replenishment pump unit 150 is constituted of the water replenishment head part 156 pressed by the pressing plate 102 to be vertically moved, the water replenishment piston part 154 that temporarily retains water and ejects the water to the water replenishment head part 156, and the water replenishment tank part 152 for storing water to be supplied to the water replenishment piston part 154. Water ejected from the water replenishment piston part 154 by the vertical movement of the water replenishment head part 156 is supplied to the water reservoir 88 through a water replenishment joint part 158 whose projection port extends from the water replenishment head part 156 to the replenishment port 98 of the water application/pressurizing part 80.

A moving plate 176 is provided in the water replenishment tank part 152 so as to be vertically moved with a reduction in the amount of water every time the water is ejected to the water replenishment joint part 158 by the water replenishment piston part 154 to be described using FIGS. 11 to 13. An air hole 178 allowing the movement of the moving plate 176 is formed in the water replenishment tank bottom 175 of the water replenishment tank part 152.

[Water Replenishment Piston Part]

The following describes the water replenishment piston part 154 that ejects water to the water replenishment head part 156 with reference to FIGS. 11 and 12. The water replenishment piston part 154 has a tank cap 172 screwed to the water replenishment tank part 152 and a water replenishment cylinder 167 that is fixed to the tank cap 172 and temporarily retains water from the water replenishment tank part 152. A sealing 171 is provided between the tank cap 172 and the water replenishment tank 174 of the water replenishment tank part 152. In the binding unit 60, the tank cap 172 is supported by being fitted into a curved portion (see FIGS. 6 and 8) below the replenishment port 98 of the pressure teeth support part 84.

Further, an upper piston 162 is provided at the upper portion of the water replenishment cylinder 167. The upper piston 162 is vertically moved by the vertical movement of the water replenishment head part 156. The upper piston 162 is wound with an upper spring 169, and a pump valve 165 also wound with the upper spring 169 is disposed below the upper piston 162. Inside the pump valve 165, a lower piston 163 wound with a lower spring 170 is positioned between the pump valve 165 and the lower portion of the water replenishment cylinder 167. A lower piston protrusion portion 164 pressed to the pump valve 165 for sealing is provided in the circumferential direction of the lower piston 163. The lower piston protrusion portion 164 is pressed by the lower spring 170.

A ball valve 166 for taking in water from the water replenishment tank 174 and for sealing inside the water replenishment cylinder 167 is provided at the lower end of the water replenishment cylinder 167. When the pressure inside the water replenishment cylinder 167 is increased, the ball valve 166 is positioned at the lower end of the water replenishment cylinder 167; while, when the pressure inside the water replenishment cylinder 167 is reduced, the ball valve 166 is moved slightly upward so as to take in water from the water replenishment tank 174.

[Water Replenishment Operation]

As illustrated in FIG. 13, in the thus configured water replenishment pump unit 150, when the water replenishment head part 156 is pressed by the pressing plate 102 to be moved down, the upper piston 162 is also moved down. This presses the upper spring 169 wound around the upper piston 162 to press the pump valve 165. Since the pump valve 165 is thus moved down, the ball valve 166 closes the lower end of the water replenishment cylinder 167, so that the internal pressure of the water replenishment cylinder 167 increases.

When the internal pressure of the water replenishment cylinder 167 exceeds a certain value, the upper spring 169 wound around the pump valve 165 and the upper piston 162 contracts, whereby a gap is generated between the pump valve 165 and lower piston protrusion portion 164. Through this gap, water in the water replenishment cylinder 167 goes outside and is then passed through the pump valve 165, the upper portion of the lower piston 163, and the upper piston 162 as denoted by the arrows of FIG. 13 to be ejected from the water replenishment joint part 158 of the water replenishment head part 156 to the water reservoir 88. When the amount of water in the water replenishment tank 174 reduces, the moving plate 176 is moved up due to decompression inside the water replenishment tank 174 so as to maintain the liquid surface level in the water replenishment tank 174 constant.

As described above, the water in the water replenishment tank 174 is supplied to the replenishment port 98 of the water application/pressurizing part 80 through the water replenishment joint part 158 every time the water replenishment head part 156 is pressed by the pressing plate 102. The mechanism of the water replenishment pump unit 150 illustrated in FIGS. 10 to 13 is described in detail in Japanese Patent Application Laid-Open Publication No. 2014-240286 that discloses a similar device.

The following describes a crimp-binding operation for a sheet bundle placed on the processing tray 58 performed in the disclosed binding unit 60. When executing the crimping using the pair of pressure teeth (pressure teeth 82 and receiving teeth 130), the binding unit 60 can select whether to perform water application (water application/crimp-binding, in which crimping is performed after applying water to the crimping part) or not (crimp-binding without water application).

[Crimp-Binding without Water Application]

Figure 14A:
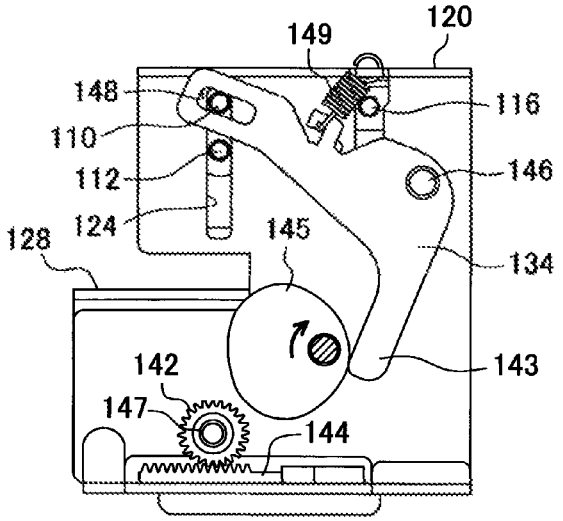
Figure 14B:
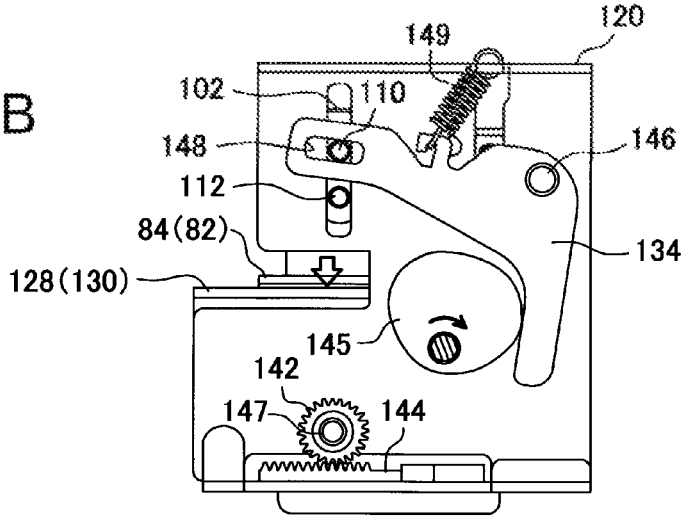
Figure 14C:
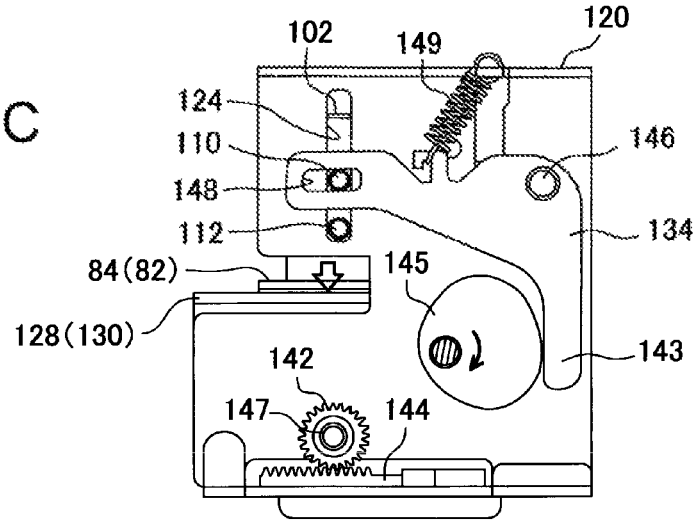
Figure 15A:
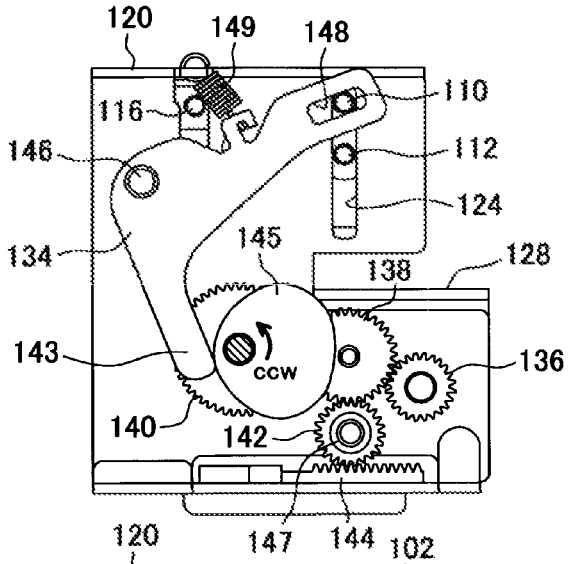
Figure 15B:
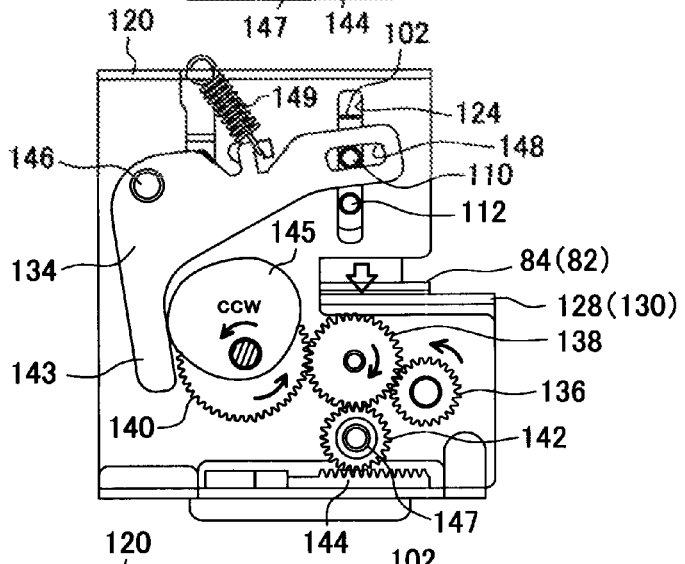
Figure 15C:
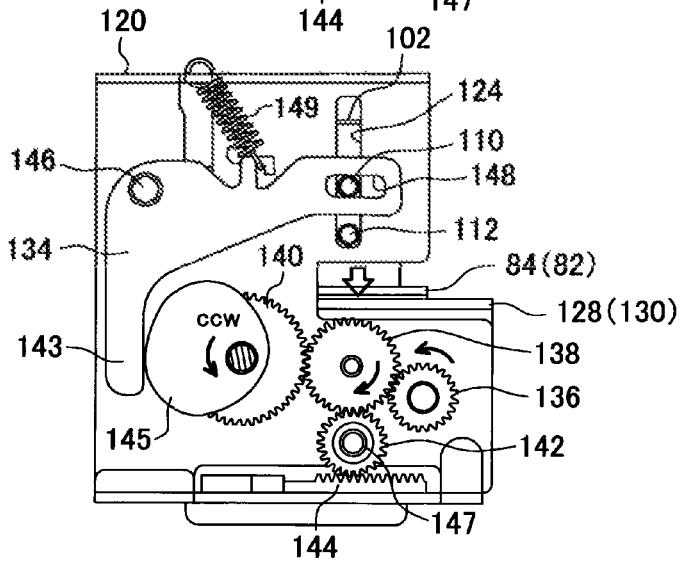
Figure 16A:
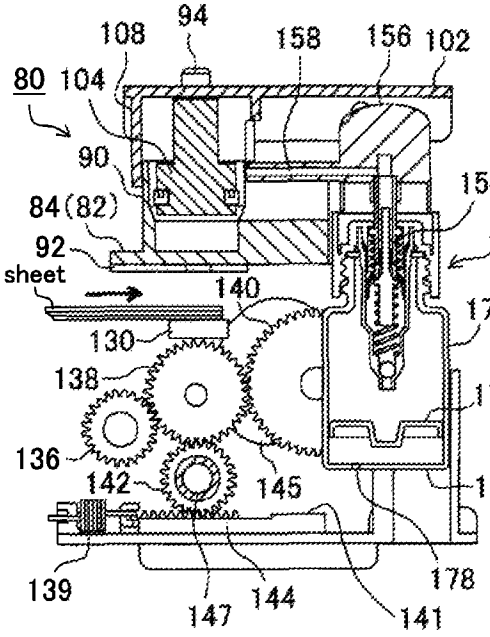
Figure 16B:
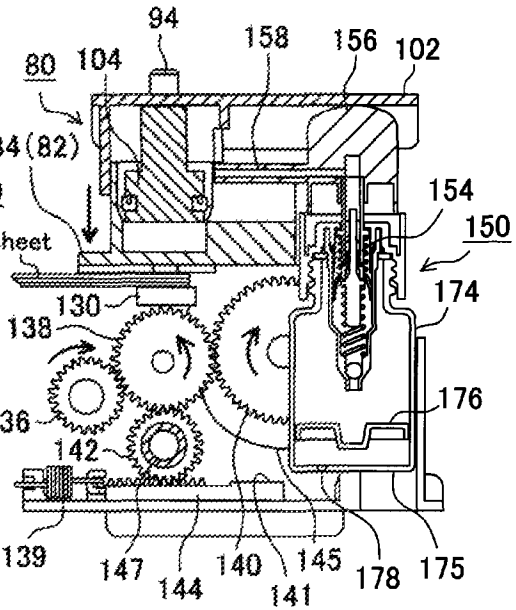
Figure 16C:
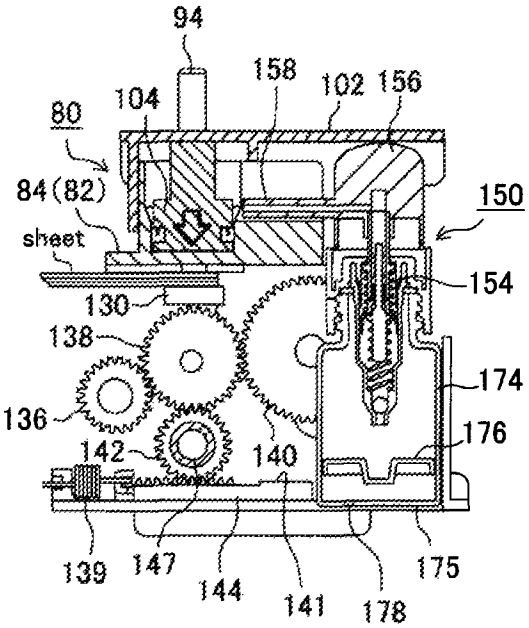

With reference to FIGS. 14A to 16C, the crimp-binding using the pressure teeth 82 without applying water to the crimping range will be described. FIGS. 14A to 14C are views illustrating the binding unit 60 as viewed from the front side, FIGS. 15A to 15C are views of the binding unit 60 as viewed from the rear side, and FIGS. 16A to 16C are cross-sectional views of the binding unit 60. FIGS. 14A, 15A, and 16A illustrate a state where the pressure teeth support part 84 (pressure teeth 82) is separated from sheets, FIGS. 14B, 15B, and 16B illustrate a state where the pressure teeth support part 84 is brought into pressure contact with sheets, and FIGS. 14C, 15C, and 16C illustrate a state where sheets are crimped without water application.

FIGS. 14A, 15A, and 16A illustrate a sheet receiving stage. Sheets are placed on the processing tray 58. More specifically, the sheets are placed on the receiving teeth support part 128 and between the pressure teeth 82 and the receiving teeth 130 of the binding unit 60. For descriptive convenience, the sheets are not illustrated in FIGS. 14A to 15C and illustrated in FIGS. 16A to 16C. When the specified number of sheets are loaded on the receiving teeth support part 128 provided with the receiving teeth 130, the binding motor 60M starts driving.

In this case, water application is not performed, so that the binding motor 60M is driven in a direction to turn the moving cam 145 in the clockwise direction on the front side (FIGS. 14A to 14C) and turn the moving cam 145 in the counterclockwise direction on the rear side (FIGS. 15A to 15C). This moves the protruding side of the moving cam 145 in a direction to press down the leading end of the turning arm 134. On the other hand, the pinion gear 142 (pinion gear 142*b*) engaged with the intermediate gear 138 does not move the support rack 144 by the action of the one-way clutch 147.

In the state illustrated in FIGS. 14B, 15B, and 16B, the pressing plate 102 is moved down to bring the pressure teeth support part 84 having the pressure teeth 82 into close contact with the sheets. When the pressing plate 102 is pressurized in this state, the pressure teeth support part 84 is pressed against the sheets by the compression spring 96 interposed between the pressing plate 102 and the pressure teeth support part 84. The elastic member (rubber plate) 92 that surrounds the pressure teeth 82 is provided in the pressure teeth support part 84 on the pressure teeth 82 side and is brought into pressure contact with the sheets so as not to generate a gap between the pressure teeth 82 and the sheet surface. In the device disclosed herein, a force of 70 kgf to 100 kgf is applied to the sheets.

In the state illustrated in FIGS. 14C, 15C, and 16C, the turning arm 134 is moved by the moving cam 145 in a state where the pressure teeth support part 84 is brought into close contact with the sheets to move down the pressing plate 102. Then, the piston 104 is inserted inside the cylinder 90 to directly press the pressure teeth support part 84 to crimp the sheets with the pressure teeth 82. At this time, a voltage to the binding motor 60M is controlled so as to generate a pressurizing force of 500 kgf to 700 kgf (600 kgf in the device disclosed herein). The control of the output torque of the binding motor 60M is disclosed in Japanese Patent Application Laid-Open Publication No. 2015-199234 and the like and is already known, so description thereof is omitted here.

In the water replenishment pump unit 150, the water replenishment head part 156 is pressed by the pressing plate 102 in a state where the water replenishment pump unit 150 is sandwiched between the pressing plate 102 and the support rack 144, whereby the water reservoir 88 is replenished with water from the water replenishment piston part 154. However, in the state illustrated in FIG. 16C, the support rack 144 does not support the water replenishment tank bottom 175, so that the water replenishment pump unit 150 itself is moved down to prevent an action of the water replenishment piston part 154.

As a result, water is not ejected from the water replenishment piston part 154 and, therefore, the water reservoir 88 is not replenished with water and is left empty. In this state, the pressure teeth 82 are brought into pressure contact with the sheets to crimp-bind the sheet bundle without water application. That is, as already described, the pinion gear 142 (pinion gear 142*b*) does not move the support rack 144 by the action of the one-way clutch 147, so that the water replenishment piston part 154 is not operated. In the device disclosed herein, up to five sheets can be subjected to the crimp-binding without water application at a time. The reason for this will be described later.

[Crimp-Binding with Water Application]

Figure 17A:
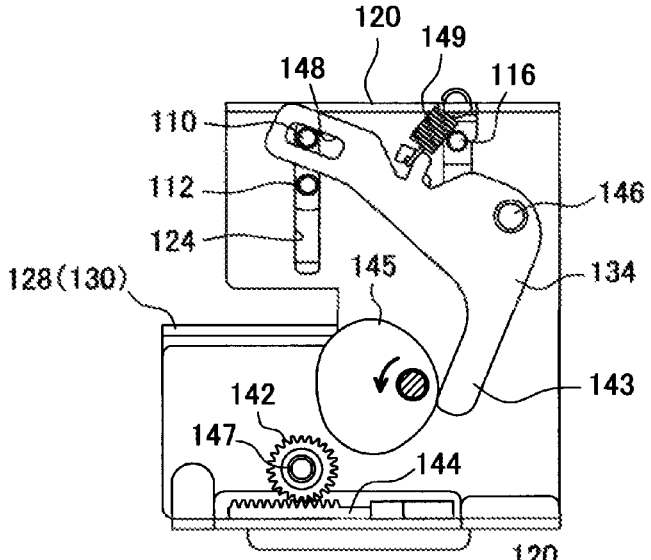
Figure 17B:
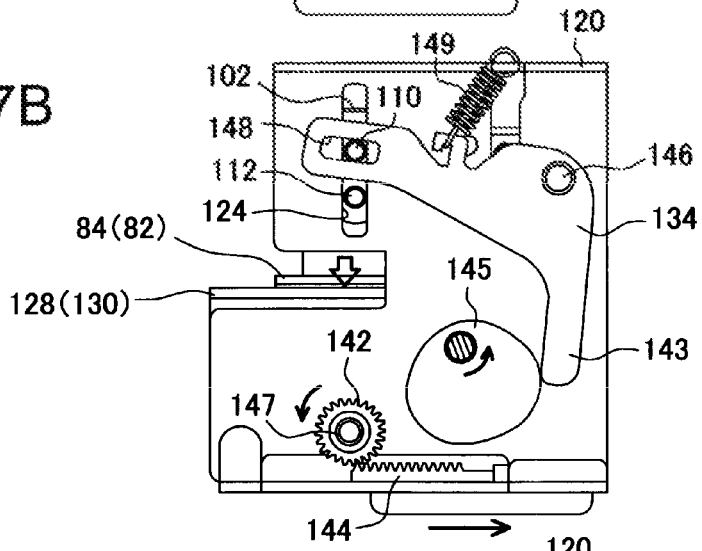
Figure 17C:
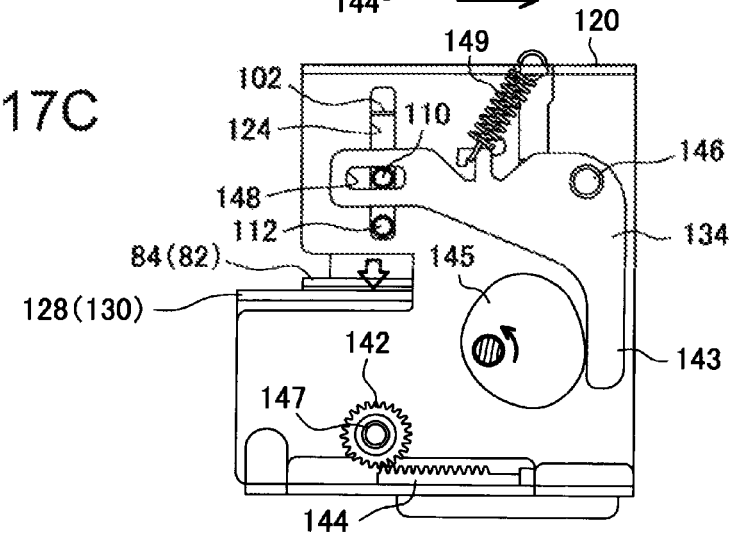
Figure 18A:
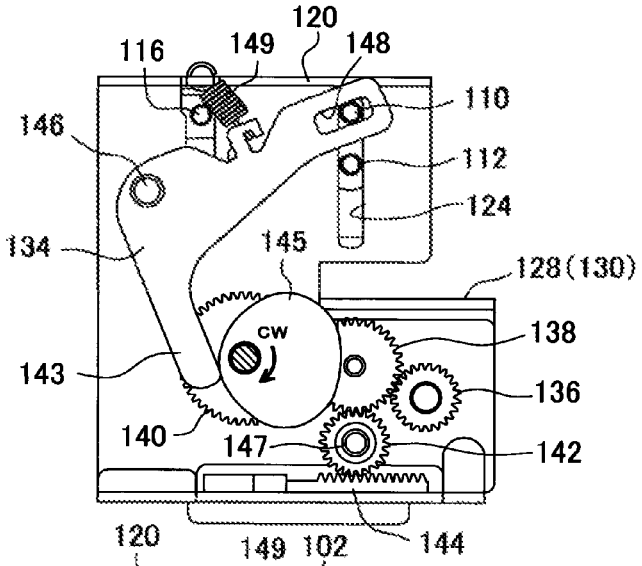
Figure 18B:
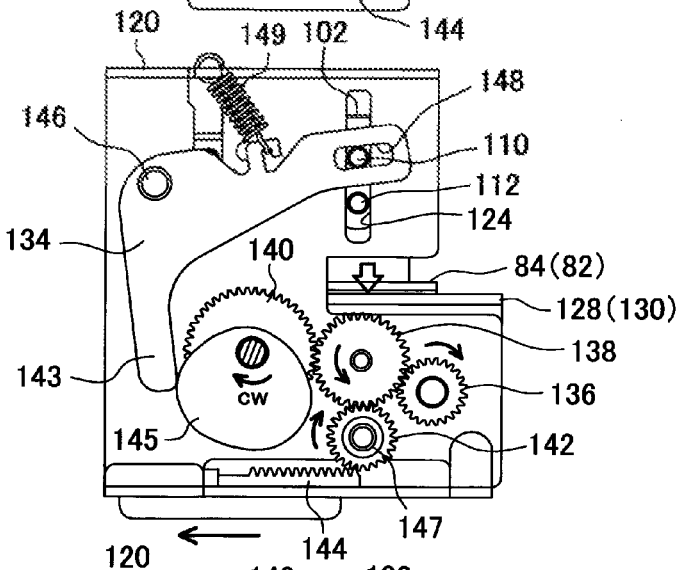
Figure 18C:
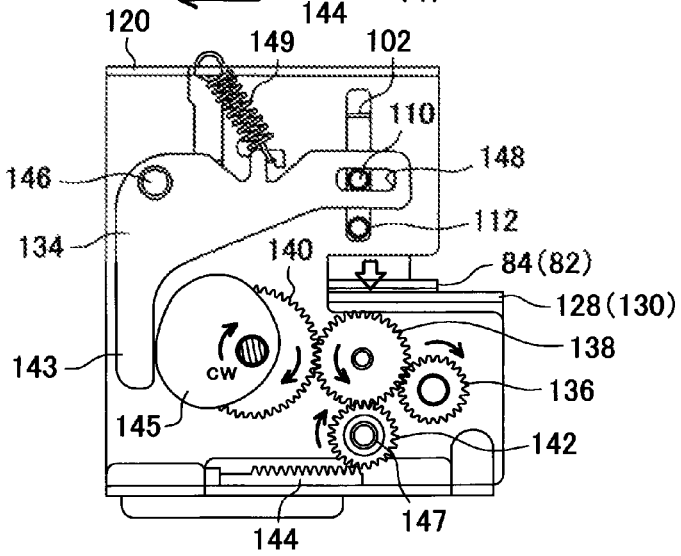
Figure 19A:
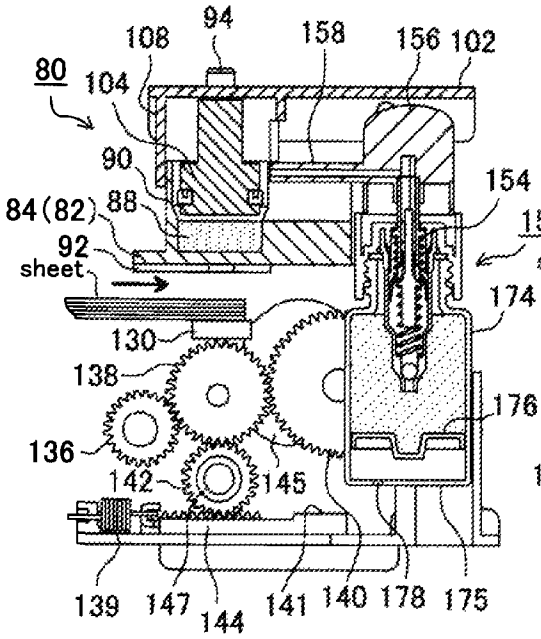
Figure 19B:
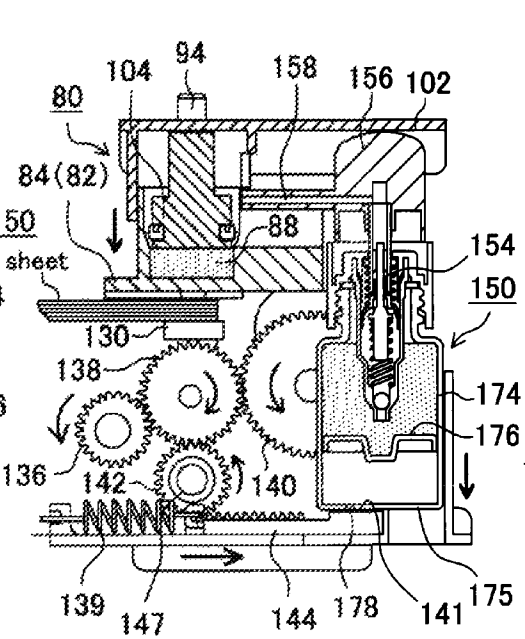
Figure 19C:
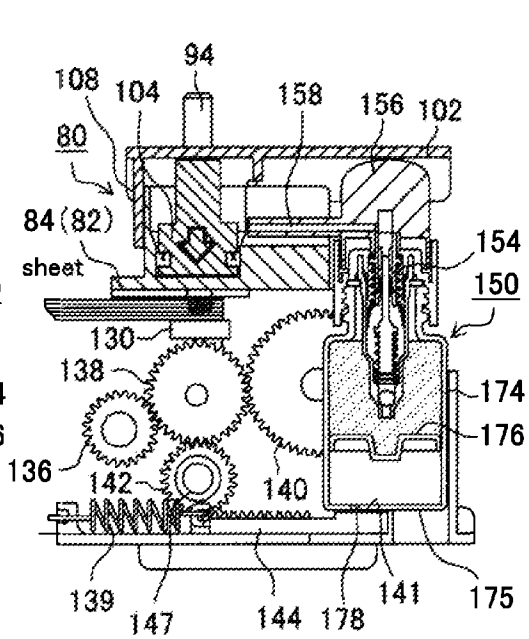

The following describes the water application/crimp-binding in which water is applied to the crimping range before crimping operation of the pressure teeth 82 with reference to FIGS. 17A to 19C. FIGS. 17A to 17C are views illustrating the binding unit 60 as viewed from the front side, FIGS. 18A to 18C are views of the binding unit 60 as viewed from the rear side, and FIGS. 19A to 19C are cross-sectional views for explaining the water application/crimp-binding. FIGS. 17A, 18A, and 19A illustrate a state where the pressure teeth support part 84 (pressure teeth 82) is separated from sheets, FIGS. 17B, 18B, and 19B illustrate a state where the pressure teeth support part 84 is brought into pressure contact with sheets, and FIGS. 17C, 18C, and 19C illustrate a state where sheets are crimped with water application.

FIGS. 17A, 18A, and 19A illustrate a sheet receiving stage. Sheets are placed on the processing tray 58. More specifically, the sheets are placed on the receiving teeth support part 128 and between the pressure teeth 82 and the receiving teeth 130 of the binding unit 60. For descriptive convenience, the sheets are not illustrated in FIGS. 17A to 18C and illustrated in FIGS. 19A to 19C. When the specified number of sheets are loaded on the receiving teeth support part 128 provided with the receiving teeth 130, the binding motor 60M starts driving. In this case, since water application is performed, the binding motor 60M is rotated in the direction opposite to the direction illustrated in FIGS. 14A to 16C in which the sheets are crimp-bound without water application. The number of sheets placed in this case is larger than five (eight in the device disclosed herein).

That is, in this case, water application is performed, so that the binding motor 60M is driven in a direction to turn the moving cam 145 in the counterclockwise direction on the front side (FIGS. 17A to 17C) and turn the moving cam 145 in the clockwise direction on the rear side (FIGS. 18A to 18C). The moving cam 145 has a symmetric shape with respect to the rotation position, so that, also in this case, the protruding side of the moving cam 145 is moved in a direction to press down the leading end of the turning arm 134. On the other hand, the pinion gear 142 (pinion gear 142*b*) engaged with the intermediate gear 138 is rotated to move the support rack 144 by the action of the one-way clutch 147 in such a direction that the support rack 144 supports the water replenishment tank bottom 175.

That is, the support rack 144 mates with the one-way clutch 147 interposed between the pinion gear 142 (pinion gear 142*b*) and its shaft by one rotation direction (clockwise direction in FIGS. 18A to 18C) of the binding motor 60M to move to a position at which it supports the water replenishment tank bottom 175. As a result, the water replenishment tank bottom 175 is fixed, and when the water replenishment head part 156 is pressed by the pressing plate 102, the water replenishment piston part 154 is operated, with the result that water in the water replenishment tank 174 is supplied to the water reservoir 88 through the water replenishment joint part 158. As illustrated in FIGS. 19A to 19C, a rack return spring 139 is interposed between the support rack 144 and the outer frame 120. The rack return spring 139 is disengaged when the shaft thereof is reversely rotated to return the support rack 144 to its original position.

In the state illustrated in FIGS. 17B, 18B, and 19B, the pressing plate 102 is moved down to bring the pressure teeth support part 84 having the pressure teeth 82 into close contact with the sheets. When the pressing plate 102 is pressurized in this state, the pressure teeth support part 84 is pressed against the sheets by the compression spring 96 interposed between the pressing plate 102 and the pressure teeth support part 84. The elastic member (rubber plate) 92 that surrounds the pressure teeth 82 is provided in the pressure teeth support part 84 on the pressure teeth 82 side and is brought into pressure contact with the sheets so as not to generate a gap between the pressure teeth 82 and the sheet surface. In the device disclosed herein, a force of 70 kgf to 100 kgf is applied to the sheets. In this stage, water is retained in the water reservoir 88 by the operation of the water replenishment piston part 154; however, the piston 104 does not arrive at a position where pressurization occurs between itself and the cylinder 90, so that water application by pressurization is not performed.

In the state illustrated in FIGS. 17C, 18C, and 19C, the turning arm 134 is moved by the moving cam 145 in a state where the pressure teeth support part 84 is brought into close contact with the sheets to move down the pressing plate 102. Then, the piston 104 inserted inside the cylinder 90 to apply water in the water reservoir 88 to the sheets through the water supply holes (water supply tubes) 86 formed in the pressure teeth 82. After water application as well, the pressing plate 102 is moved by the moving cam 145 in a direction crimping the sheets, with the result that the piston 104 presses the pressure teeth 82 against the receiving teeth 130 to crimp the sheets. The pressurizing force in the crimp-binding with water application can be adjusted to be smaller than that in the crimp-binding without water application and is 300 kgf to 400 kgf. In the device disclosed herein, a voltage to the binding motor 60M is controlled so as to generate a pressurizing force of 350 kgf.

As already described above, in the water replenishment pump unit 150, the water replenishment head part 156 is pressed by the pressing plate 102 in a state where the water replenishment pump unit 150 is sandwiched between the pressing plate 102 and the support rack 144, whereby the water reservoir 88 is replenished with water from the water replenishment piston part 154. That is, as illustrated in detail in FIGS. 19B and 19C, the support rack 144 supports the water replenishment tank bottom 175 from below, and the water replenishment pump unit 150 is fixed. As a result, water is ejected from the water replenishment piston part 154 and supplied to the water reservoir 88. In the device disclosed herein, eight sheets are placed on the processing tray 58 and subjected to the water application/crimp-binding.

[Pressure Teeth and Receiving Teeth of Water Application/Pressurizing Part]

Figure 20A:
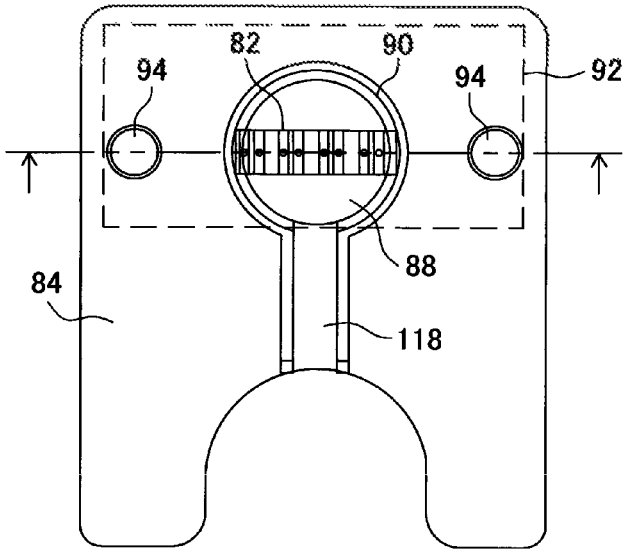

Hereinafter, the pressure teeth 82 and the receiving teeth 130 of the water application/pressurizing part 80 will be described using FIGS. 20A to 20C, and a mating state between the pressure teeth 82 and the receiving teeth 130 and the position of the water supply holes (water supply tubes) 86 will be described using FIG. 21. FIG. 20A is a plan view of the pressure teeth 82. As described above, the cylinder 90 that retains water to be applied to sheets is provided on the back side of the pressure teeth 82 (the side of the pressure teeth support part 84 opposite to the side at which the pressure teeth 82 bite the sheets). The cylinder 90 has a partially cut cylindrical shape and is constituted of a range (water reservoir 88) in which the piston 104 pressurizes water for water application, a piston insertion guide having a diameter larger than the water reservoir 88, and a water replenishment port 118 through which water from the water replenishment pump unit 150 is received.

Figure 20B:
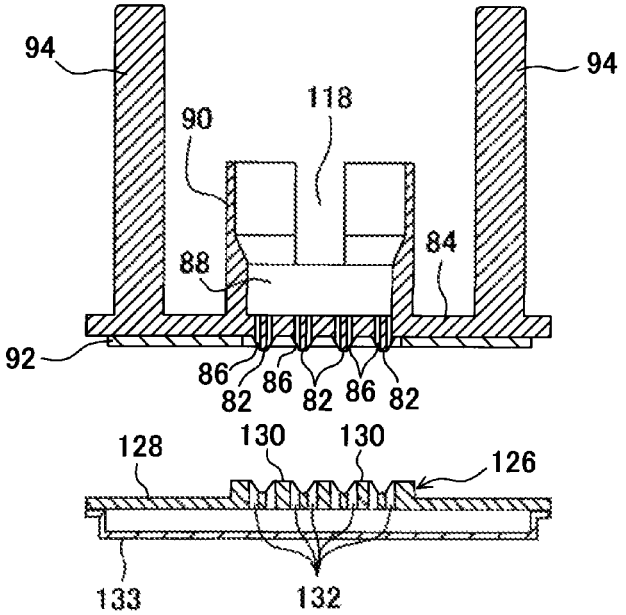

FIG. 20B is a cross-sectional view of the pressure teeth 82 denoted by a chain double-dashed line in FIG. 20A and the receiving teeth part 126. As is clear from FIG. 20B, the pressure teeth support part 84 is integrally formed with the pressure teeth 82 and the cylinder 90 and guide bar 94 provided on the back side of the pressure teeth 82. This ensures strength and easy assembly. The receiving teeth 130 (receiving teeth part 126) that mate with the pressure teeth 82 are provided at a position facing the pressure teeth support part 84. Further, the drain pan 133 for receiving water (residual water) remaining at water application is disposed below the receiving teeth 130.

Further, the water supply holes (water supply tubes) 86 for allowing water in the water reservoir 88 to be applied to the sheets are formed in the respective slopes of the pressure teeth 82. Further, communication holes 132 are formed in the respective slopes of the receiving teeth 130. Through the communication holes 132, air pushed at the time of sheet pressing by the pressure teeth support part 84 and water remaining at water application are made to pass outside the receiving teeth 130. The communication holes 132 have a larger capacity than that of the water supply holes (water supply tubes) 86, whereby air and water can be effectively discharged.

Figure 20C:
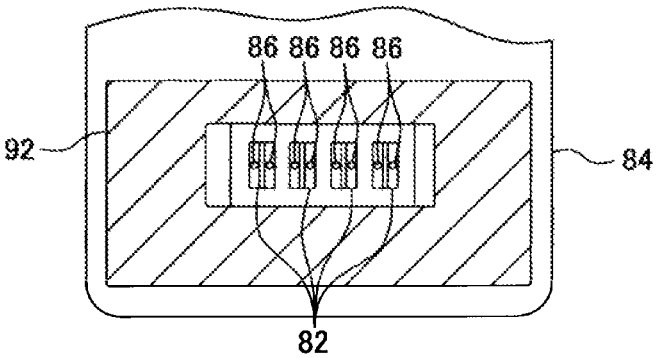

FIG. 20C illustrates the pressure teeth support part 84 as viewed from the bottom (pressure teeth 82 side) thereof. As illustrated, the elastic member 92 made of a rubber material that surrounds the pressure teeth 82 is bonded to the pressure teeth support part 84. This can eliminate a gap around the pressure teeth 82 in a process that the pressure teeth support part 84 is pressed against the sheets by the compression spring 96, thereby suppressing water applied outside the crimping/pressurization area from spreading.

[Arrangement of Water Supply Holes (Water Supply Tubes) and Communication Holes]

Figure 21:
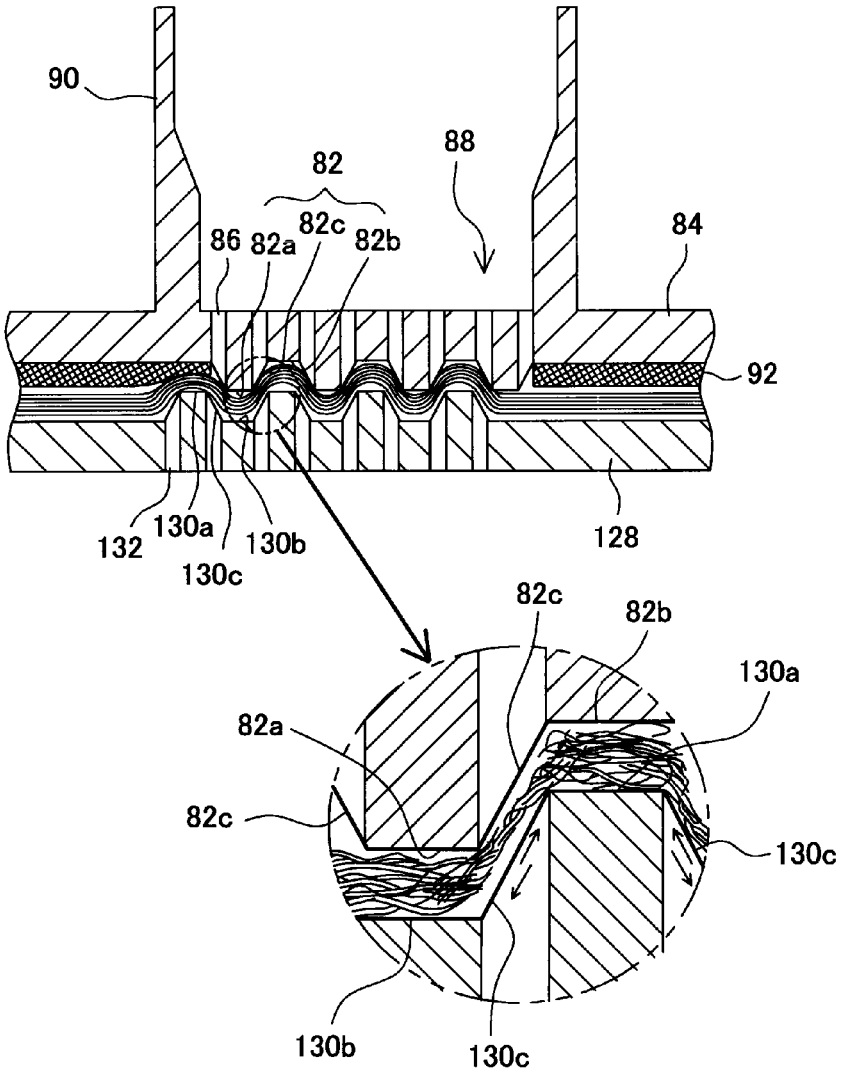
FIG. 21 is an enlarged view for explaining a state where the pressure teeth and the receiving teeth mate with each other, in which the chain double-dashed circle is an enlarged view of the mating state.

The following describes the water supply holes (water supply tubes) 86 formed in the pressure teeth 82 (FIGS. 20A to 20C) and the communication holes 132 (FIG. 20B) formed in the receiving teeth 130 so as to communicate with the outside (drain pan 133) using FIG. 21. FIG. 21 is an enlarged view for explaining the pressure teeth 82 and the receiving teeth 130. The pressure teeth 82 include ridges 82*a*, valleys 82*b*, and slopes 82*c* connecting the ridges 82*a* and valleys 82*b*. Similarly, the receiving teeth 130 include receiving ridges 130*a*, receiving valleys 130*b*, and receiving slopes 130*c*. Thus configured pressure teeth 82 and receiving teeth 130 mate with each other to make the sheet bundle partially form ridges and valleys, thereby facilitating mutual entanglement of the fibers of the sheets.

Water in the water reservoir 88 inside the cylinder 90 is ejected through the water supply holes (water supply tubes) 86 formed in the pressure teeth 82 by pressing of the piston 104. At this time, the water is ejected from the plurality of slopes 82*c* as illustrated. It is confirmed that, as illustrated in the chain double-dashed circle of FIG. 21, when the pressure teeth 82 and the receiving teeth 130 mate with each other so as to make the sheets form ridges and valleys, fibers (in the case of a paper material, cellulose fibers) of the sheets are unfolded to a higher degree in the slopes 82*c* and receiving slopes 130*c* (indicated by the opposing arrows in FIG. 21).

When water is applied to the slope where fibers are unfolded to the highest degree, the water is easily permeated into the sheet, facilitating mutual entanglement of the fibers by subsequent pressurization and so-called hydrogen bond. Thus, in the disclosed invention, the water supply holes (water supply tubes) 86 are formed in the respective slopes 82*c* of the pressure teeth 82. Further, as described above, the communication holes 132 having a larger capacity than that of the water supply holes (water supply tubes) 86 are formed in the respective receiving slopes 130*c* of the receiving teeth 130 so as to facilitate discharge of air and water therethrough.

[Pressure Teeth Support Part and Receiving Teeth Support Part]

Figure 22:
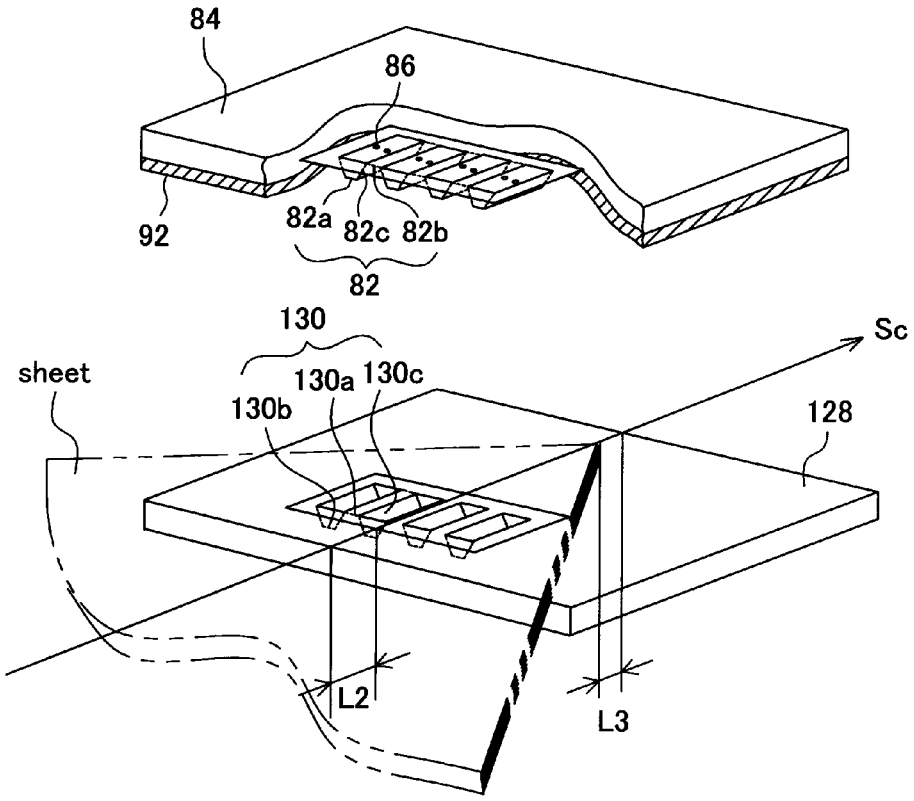
FIG. 22 is a view for explaining the position of the sheet bundle held between a pressure teeth support part and a receiving teeth support part.

The following describes the relationship between the positions of the pressure teeth support part 84 and receiving teeth support part 128 and the position of the sheets held and pressed between the pressure teeth support part 84 and the receiving teeth support part 128 with reference to FIG. 22 and FIGS. 23A to 23C. FIG. 22 illustrates the position of the sheet bundle to be subjected to the crimp-binding at the corner thereof on the front side of the processing tray 58 (see FIG. 3). In the device disclosed herein, when the sheet bundle is crimped at the corner thereof, the sheet position is regulated such that the pressure teeth support part 84 that crimps the sheet bundle with the pressure teeth 82 and the receiving teeth support part 128 that supports the receiving teeth 130 mating with the pressure teeth 82 protrude from the apex of the corner of the sheet bundle by a dimension of L3. That is, the end of both the support parts 84 and 128 on the side far from the gravity center of the sheet bundle protrude from the apex of the corner of the sheet bundle by a dimension of L3. On the other hand, the ends of both the support parts 84 and 128 on the side close to the gravity center of the sheet bundle is separated from the water permeation area by a dimension of L2. That is, pressing is performed including an area where water is not applied, i.e., where the applied water is not permeated (area with a dimension of L2 extending from the end of a position where the water ejected from the pressure teeth 82 is permeated toward the gravity center of the sheet bundle).

Figure 23A:
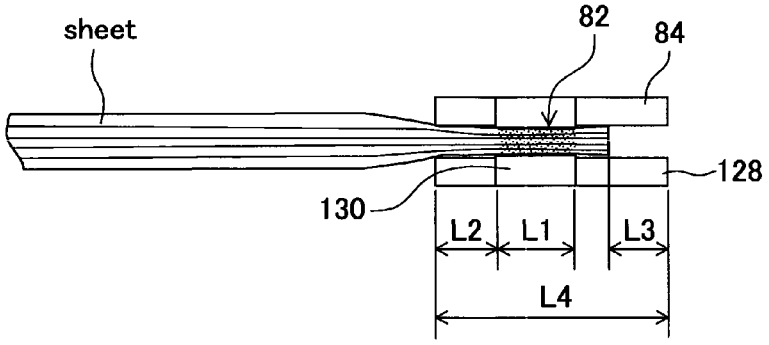

FIG. 23A is a cross-section taken along the line Sc of FIG. 22. As is clear from FIG. 23A, the pressing area of the support part 84 and the receiving teeth support part 128 includes the water application area L1 as substantially the center of the pressing area, the area protruding from the apex of the corner of the sheet bundle by a dimension of L3, and area extending toward the gravity center of the sheet bundle from the water application area L1 by a dimension of L2.

Figure 23B:
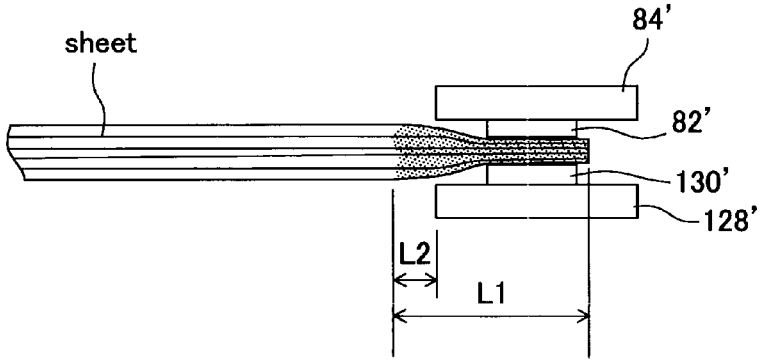

In the configuration illustrated in FIG. 23B, the water application range exceeds the sheet pressing range by a dimension of L2 toward the sheet gravity center side. Thus, fibers of the sheets remain unfolded due to water application, and the sheet may be easily torn at a position near the pressure teeth 82 on the sheet gravity center side. Further, when the sheet bundle is left as it is without being pressed, the water application range on the sheet surface is wrinkled, degrading the appearance. Thus, by adopting the configuration as illustrated in FIG. 23A in which the pressing range includes the outside of the water application range, the sheets become less likely to be torn.

Figure 23C:
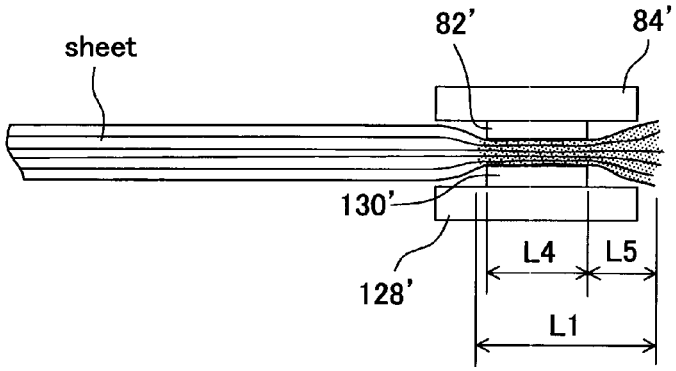

Further, in the configuration illustrated in FIG. 23C, the water application area L1 is larger than the sheet pressing region L4, and the corner of the sheet bundle protrudes outward from the pressing position by a diameter of L5. In this case, water is applied to a portion that is not pressed, so that, particularly, the corner positions of the respective sheets are liable to be varied vertically. Thus, by adopting the configuration as illustrated in FIG. 23A in which the pressing area includes the end portion of the sheet bundle, the water application position is pressed to prevent the positional variation, and the appearance is improved.

In the above description, the front side (see FIG. 3) of the processing tray 58 is taken as an example. Similarly, on the rear side as well, by adopting the configuration in which the pressing area includes a portion exceeding the sheet corner on the side far from the gravity center of the sheet bundle and a portion exceeding the water application position on the side close to the gravity center of the sheet bundle, the same effects can be obtained.

The following describes, using FIGS. 24A to 24D, a predetermined number of sheets based on which one of the crimp-binding without water application and the water application/crimp-binding, which have been described using FIGS. 14A to 19C, is performed and the number of sheets to be subjected to crimping and water application.

Figure 24A:
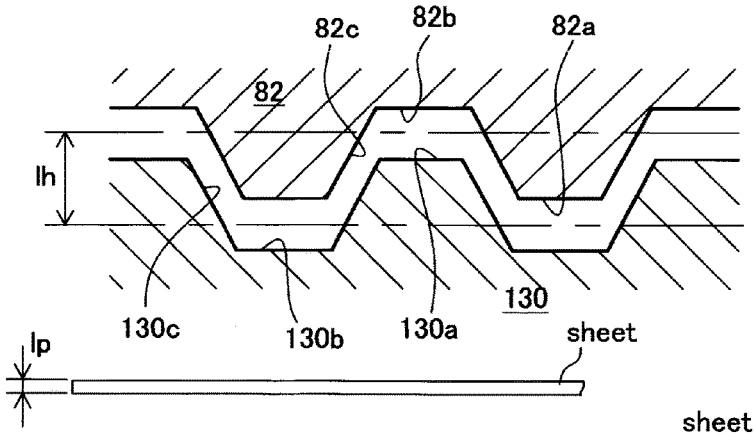

FIG. 24A is a schematic view for explaining the relationship between the pair of teeth (pressure teeth 82 as the upper-side teeth and receiving teeth 130 as the lower-side teeth) and the predetermined number of sheets. As illustrated, the ridges and valleys of the sheets are formed by a height difference lh between the upper- and lower-side teeth, in other words, a distance between the apex of the ridge 82*a* and the bottom of the valley 82*b*. Generally, the height difference is set to 0.4 mm to 0.6 mm. In the case of the pressure teeth 82 and the receiving teeth 130 in the disclosed invention, the height difference is set to 0.5 mm.

A sheet used as a normal copying paper has a basis weight of 68 g/cm$^2$ and a thickness 1p of about 0.1 mm. That is, five sheets are suitable for formation of the ridges and valleys, and when the predetermined number of sheets exceeds five, the crimping strength between the sheets becomes weak. Thus, the predetermined number of sheets to be subjected to the crimp-binding without water application in the water-application/crimp-binding unit 60 disclosed herein is set to five, and when the number of sheets exceeds five, the water application/crimp-binding is performed so as to once unfold the fibers of the sheets. Therefore, when the height difference between the upper- and lower-side teeth is 0.6 mm, the predetermined number of sheets is six, and when the height difference between the upper- and lower-side teeth is 0.4 mm, the predetermined number of sheets is four.

Figure 24B:
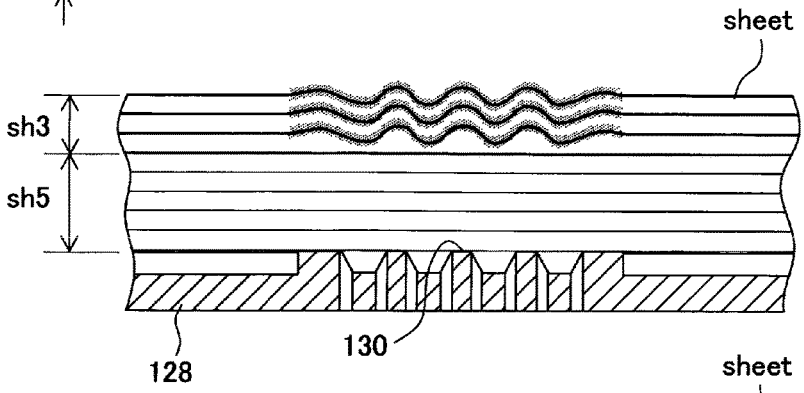
Figure 24C:
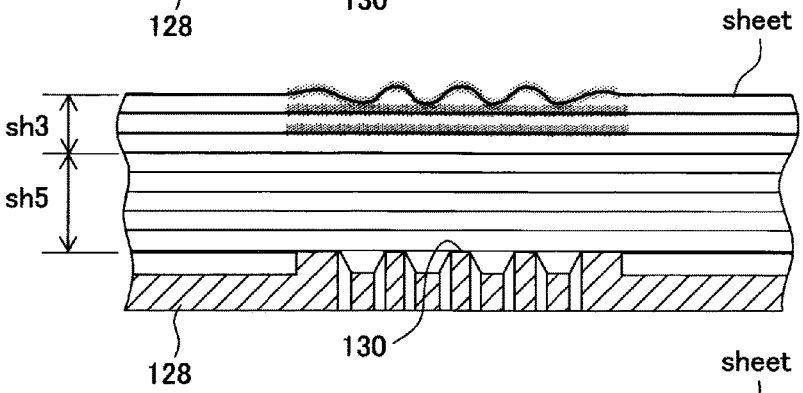
Figure 24D:
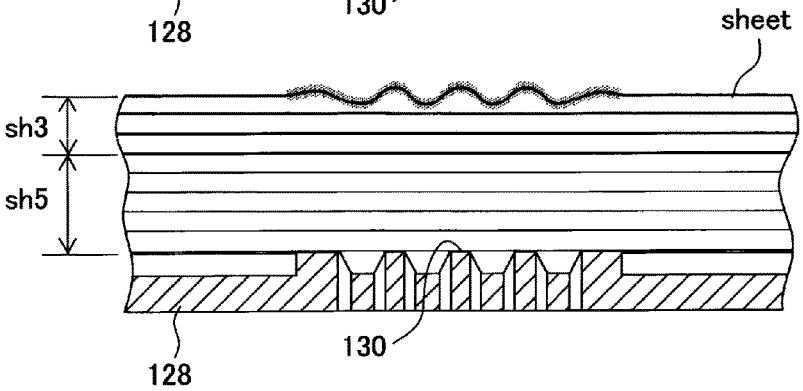

The following describes, using FIGS. 24B to 24D, patterns of the water application and crimping in the water application/crimp-binding when the sheets (in this case, three sheets are added, and thus eight sheets in total) whose number exceeds the predetermined number of sheets (five, in this case) are placed on the processing tray 58. The wavy line in the drawing represents a state where the sheets are pressed by the pressure teeth 82 and the partially added straight line represents a water-applied sheet.

[Water Application and Crimping for Each of Added Sheets]

In FIG. 24B, for each of the added three sheets, the water reservoir 88 provided on the back side of the pressure teeth 82 is replenished with water, followed by pressurization with the pressure teeth 82. The pressurization may be performed once at the timing at which the number of sheets reaches the predetermined number of sheets (five); however, this is not performed in the device disclosed herein, and water application and crimping are repeated for each of added sheets. With this configuration, sheets whose number exceeds the predetermined number can be crimp-bound. As described above, whether or not to perform the water application is switched depending on the rotation direction of the binding motor 60M.

[Water Application for Each of Added Sheets and Pressurization after Placement of Last Sheet (after Accumulation of Certain Number of Added Sheets)]

In FIG. 24C, only the water application from the water reservoir 88 is performed for each of the added three sheets, and both the water application and pressurization by the pressure teeth 82 are performed after placement of the last sheet. Like the above pattern, the pressurization is not performed at the timing at which the number of sheets reaches the predetermined number of sheets (five), and water application is repeated for each of added sheets. With this configuration, the sheets whose number exceeds the predetermined number can be crimp-bound. The water application to be performed alone is set based on the rotation direction and the rotation range of the binding motor 60M. Further, a pattern may be adopted, in which only the water application is performed for each addition, and pressurization is performed at the timing at which the number of added sheets reaches a certain number.

[Water Application and Pressurization after Placement of Last Sheet (after Accumulation of Certain Number of Added Sheets]

In FIG. 24D, water in the water reservoir 88 is applied and, at the same time, pressurization by the pressure teeth 82 is performed at the stage when three sheets are added and thus a total of eight sheets are placed on the processing tray 58. In the device disclosed herein, the water in the water reservoir 88 is pressurized at a considerably high pressure by the piston 104, so that water is easily permeated into bundled sheets.

With this configuration, sheets whose number exceeds the predetermined number can be crimp-bound. The pressurization may be performed once at the timing at which the number of sheets reaches the predetermined number (five); however, this is not performed in the device disclosed herein, and water application and crimping are performed after placement of the last sheet. When a large number of sheets are accumulated until the last sheet is placed, the water application and pressurization may be performed at the timing at which the number of added sheets reaches a certain number.

[Removal of Water Replenishment Pump Unit]

Figure 25:
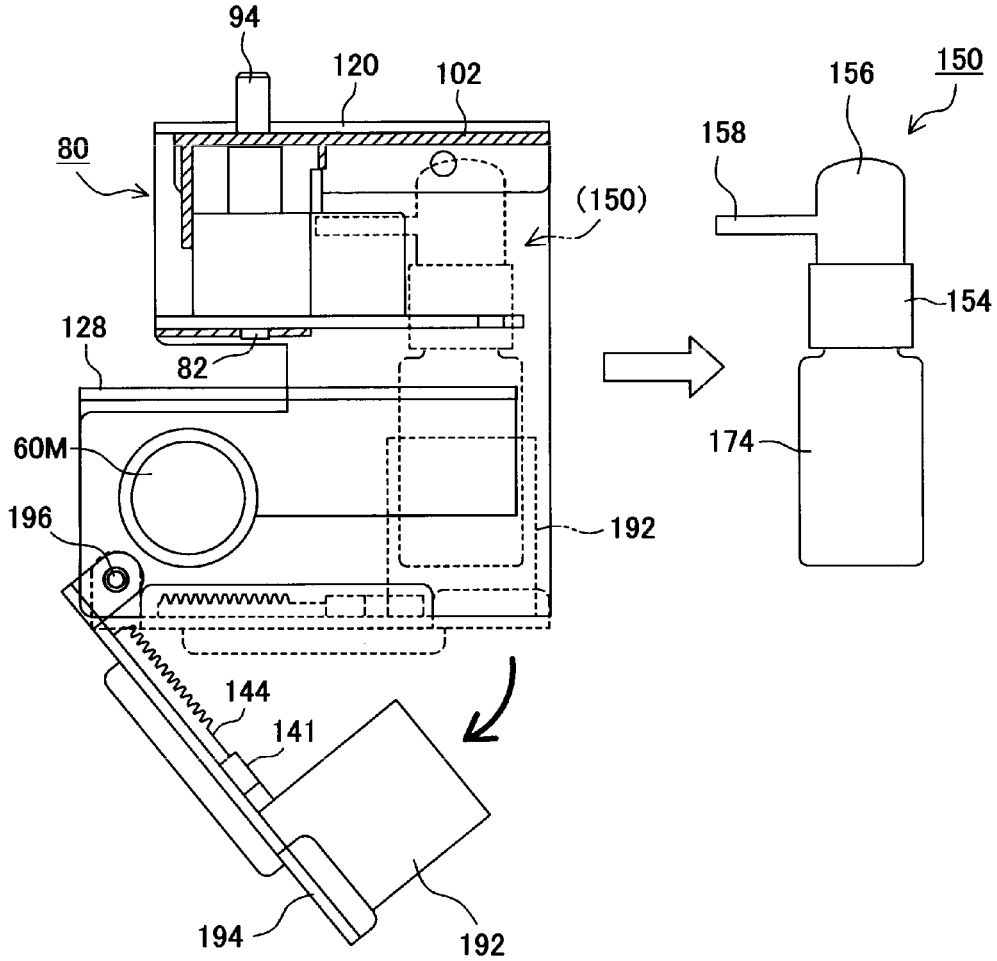
FIG. 25 is an explanatory view illustrating a state where the water replenishment pump unit is removed from the binding unit.

FIG. 25 illustrates a state where the water replenishment pump unit 150 is removed from the binding unit 60. As illustrated, a bottom frame 194 is turned about a frame turning shaft 196 provided in the outer frame 120 of the binding unit 60 to thereby remove the water replenishment pump unit 150 through a pump holding cover 192. Then, the tank cap 172 is removed from the water replenishment tank 174 and is replenished with water. FIG. 25 illustrates a state where the bottom frame 194 is turned downward; however, the pump holding cover 192 may be openably slid so as to allow the water replenishment pump unit 150 to be removed in the direction of the arrow in the drawing.

[Control Configuration]

Figure 26:
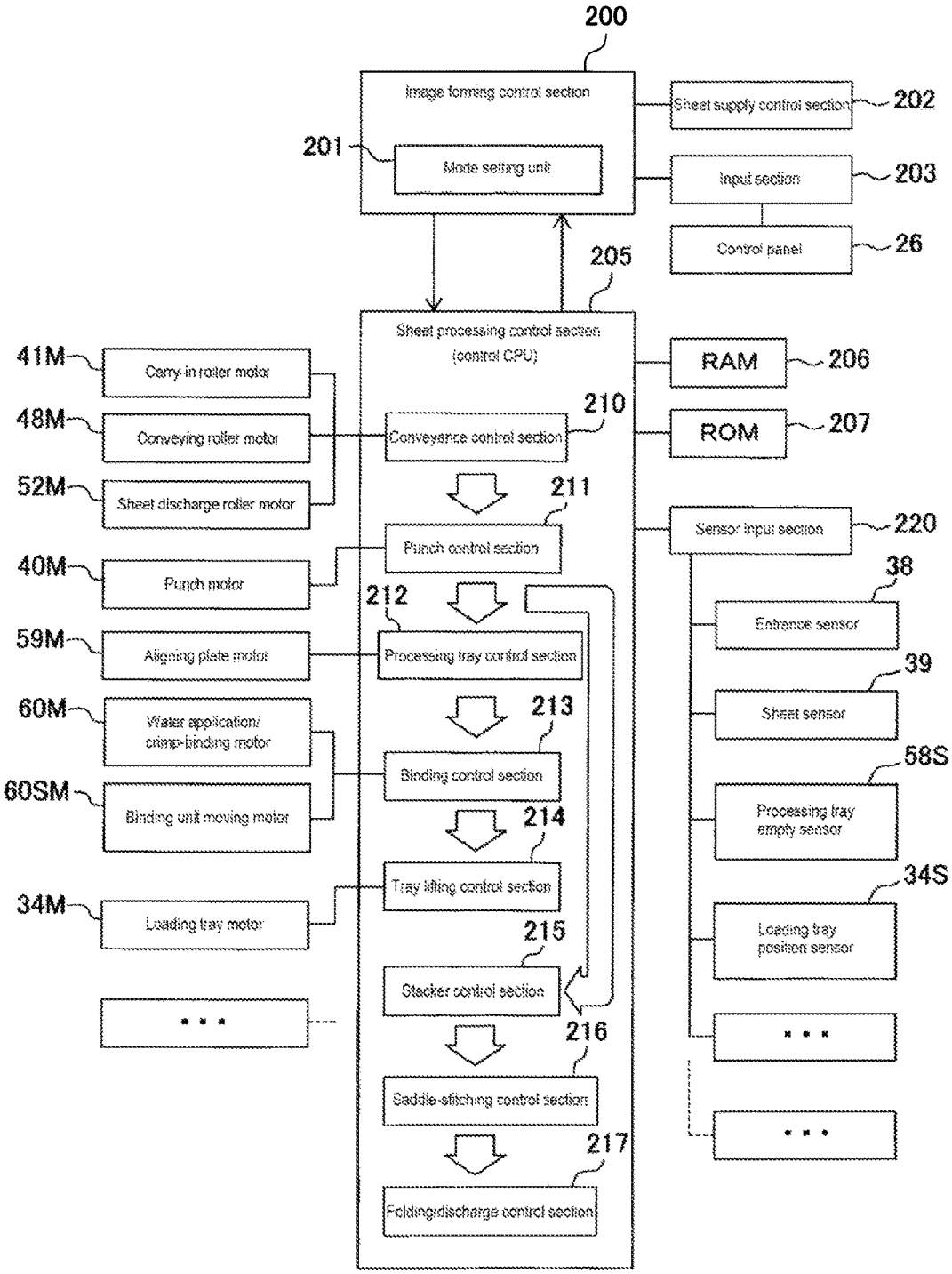
FIG. 26 is a block diagram of the control configuration of the device according to the embodiment of the present invention.

The control configuration of the image forming device A disclosed herein will be described using the block diagram of FIG. 26. The image forming device A of FIG. 1 has an image forming control section 200 of the image forming main body A1 and a sheet processing control section 205 (control CPU) of the sheet processing device B. The image forming control section 200 has a sheet supply control section 202 and an input section 203. On a control panel 26 provided in the input section 203, an operator can set the following modes: (1) printout mode; (2) jog sorting mode; (3) binding mode; (4) book-binding (saddle-stitching) mode; and (5) manual binding mode. Details of the above modes will be described later.

The sheet processing control section 205 is a control CPU that operates the sheet processing device B according to a sheet processing mode designated from among the above five modes. The sheet processing control section 205 has a ROM 207 that stores an operation program and a RAM 206 that stores control data. Further, the sheet processing control section 205 acquires detection information from a sensor input section 220.

[Sensor Input Section]

The sensor input section 220 has an entrance sensor 38 for detecting carry-in of an image-formed sheet from the image forming main body A1 and detects the front and rear ends of the sheet to thereby manage drive of motors. A sheet sensor 39 for detecting sheet jamming and the like is provided downstream of the entrance sensor 38. Further, the processing tray 58 is provided with a processing tray empty sensor 58S for detecting whether a sheet is present on the processing tray 58. Further, a loading tray position sensor 34S for detecting the surface of the loading tray 34 that accumulates thereon the sheet discharged by the sheet discharge roller 52 while being gradually lowered is provided. In addition, there are provided a sensor for the punch unit 40, a sensor for detecting the position of the binding unit 60, and a sensor for detecting the operation of the saddle-stitching unit 66 (descriptions thereof are omitted here).

[Output Section (Motors)]

The sheet processing control section 205 includes a conveyance control section 210 that controls sheet conveyance. The conveyance control section 210 controls a carry-in roller motor 41M for sheet carry-in operation and a conveying roller motor 48M for conveying a sheet to the processing tray 58.

Further, a punch control section 211 is provided for punching the rear end of a sheet carried in by the carry-in roller 41. The punch control section 211 controls a punch motor that punches a sheet at a designated position in the sheet width direction. Further, a processing tray control section 212 controls an aligning plate motor 59M that moves the aligning plates 59 that sandwich a sheet carried out to the processing tray 58 from both sides in the sheet width direction for alignment.

A binding control section 213 controls the above-described binding motor 60M and a binding unit moving motor 60SM for moving the binding unit 60 to a designated position in the sheet width direction so as to achieve two-point binding or corner binding. A sheet bundle thus bound is discharged to the loading tray 34 by a bundle moving belt (not illustrated) and the sheet discharge roller 52.

At this time, a loading tray motor 34M is controlled by a tray lifting control section 214 based on detection made by a loading tray position sensor 34S so as to keep the position of the upper surface of the sheet bundle with respect to the sheet discharge port 54 constant at all times. In addition, there are provided a stacker control section 215 and a folding/discharge control section 217 for bookbinding (saddle-stitching); however, these control sections are not directly related to the present disclosure, so descriptions thereof are omitted here.

[Sheet Processing Mode]

The sheet processing device B is a device that receives, through the entrance 36, a sheet carried out from the sheet discharge port 16 of the image forming main body A1 and processes the received sheet. The sheet processing device B has the following five processing modes: (1) printout mode in which image-formed sheets are loaded/stored; (2) jog sorting mode in which image-formed sheets are aligned and stored; (3) binding mode in which image-formed sheets are aligned, accumulated, and bound; (4) bookbinding (saddle-stitching) mode in which image-formed sheets are aligned, accumulated, and bound, and then folded into a booklet; and (5) manual binding mode in which a sheet bundle inserted into a manual insertion slit 35 is bound for each insertion.

The above binding mode and manual binding mode each have a water application/crimp-binding mode in which sheets are bound after water application to the binding position and a non-water application/crimp-binding mode in which sheets are bound without water application. In the device disclosed herein, the above modes are set based on sheet number information acquired from the image forming main body.

A determination section that determines whether or not the number of sheets to be bound is equal to or less than the predetermined number may acquire determination information from the sheet processing control section (control CPU)

205 or image forming control section. Further, the thickness of a sheet bundle to be pressurized between the pressure teeth 82 and the receiving teeth 130 may be measured by a known method and converted into the number of sheets.

The following describes modifications partially different from the above-described embodiment. Modifications 1 to 3 will be described using FIG. 27, FIG. 28, and FIG. 29, respectively. In these modifications, the same reference numerals are given to the same or similar constituent elements to those of the above embodiment.

[Modification 1—Combined Use with Stapling Unit 60SP]

Figure 27:
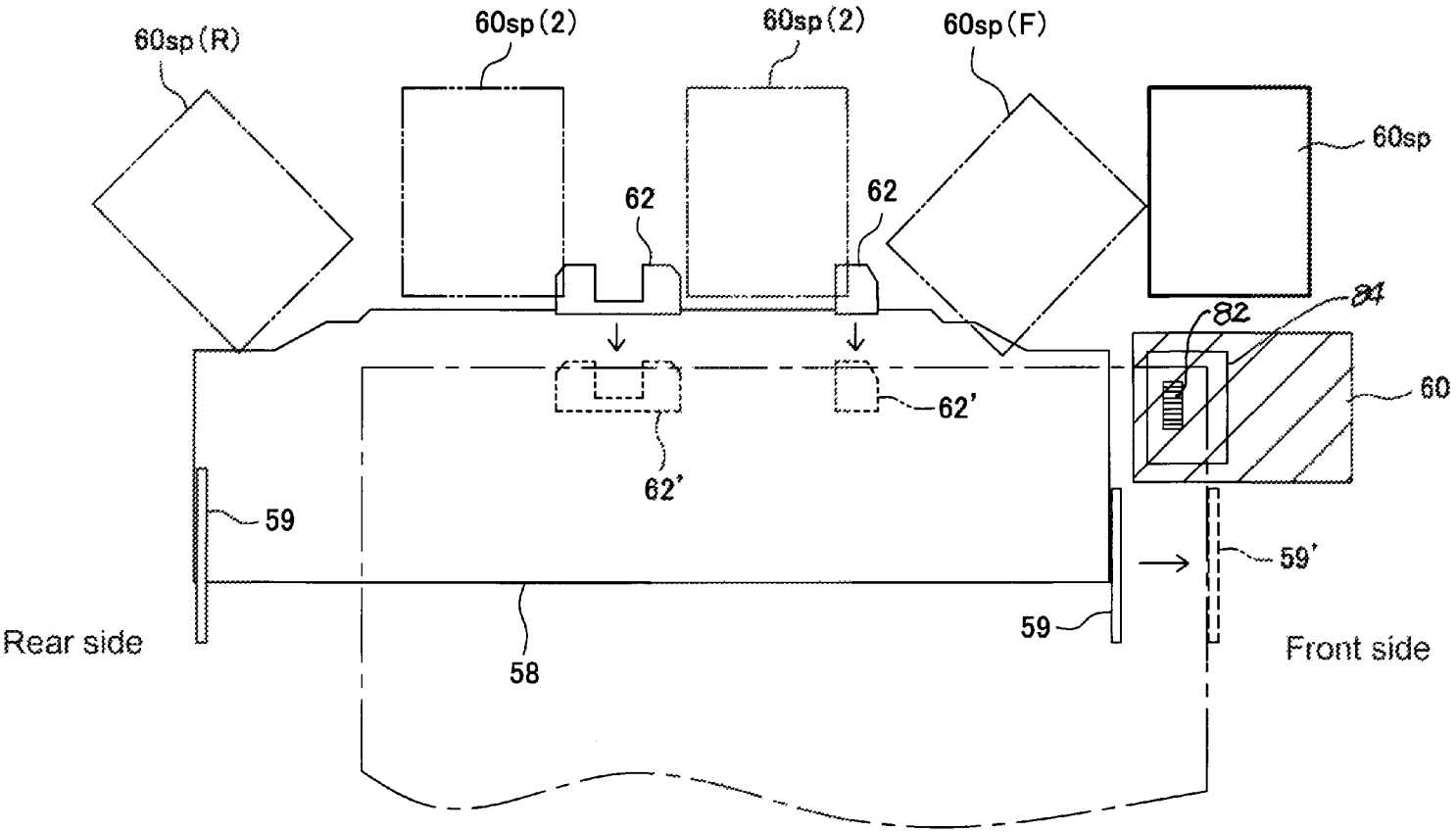
FIG. 27 is a view illustrating a modification (Modification 1) of the configuration illustrated in FIG. 3, in which a stapling unit is used in combination with the water application/crimp-binding unit.

FIG. 27 illustrates a modification of the configuration illustrated in FIG. 3, in which the water application/crimp-binding unit 60 and a stapling unit 60SP having a known mechanism are used in combination. More specifically, the front-side corner binding of a sheet bundle and manual binding of a sheet bundle are performed by the water application/crimp-binding unit 60. In the manual binding in this case, a sheet bundle is inserted into the processing tray 58, and the water application/crimp-binding is performed with the aligning plate 59 moved to a manual insertion position to guide a sheet bundle and with the reference stopper 62 moved to the position denoted by the dashed lines at the sheet bundle front side. This eliminates wasteful use of stapler needles when a sheet bundle constituted by a small number of sheets is bound, which is environmentally friendly.

[Modification 2—Positional Change of Water Supply Holes (Water Supply Tubes)]

Figure 28A:
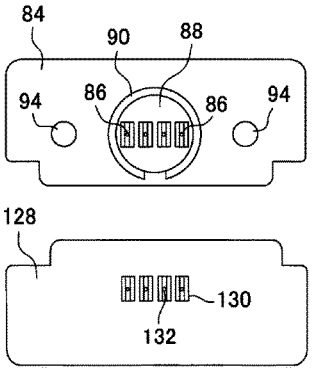
Figure 28B:
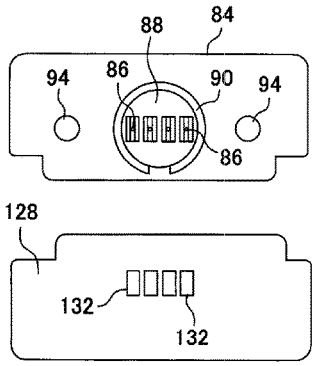
Figure 28C:
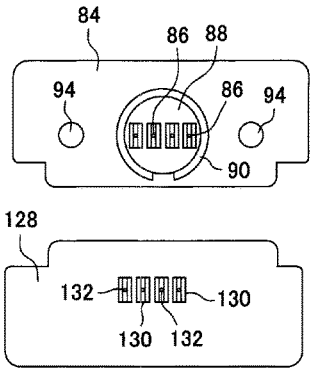
Figure 28D:
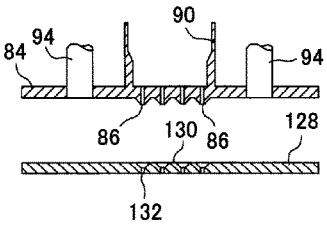
Figure 28E:
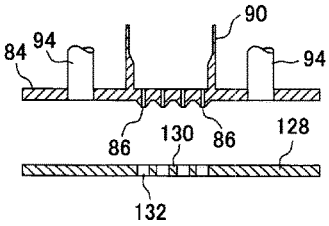
Figure 28F:
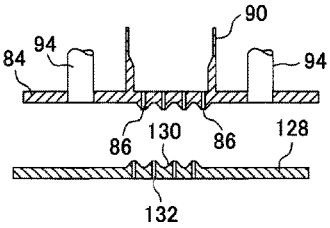

In the modification 2 illustrated in FIGS. 28A to 28C, the positions of the plurality of water supply holes (water supply tubes) 86 formed in the slopes 82*c* of the pressure teeth 82 (see particularly FIGS. 20A to 20C and FIG. 21) are changed. In the example of FIG. 28A, the water supply holes (water supply tubes) 86 are formed in the respective ridges 82*a* of the pressure teeth 82. In this case as well, water can effectively be applied to the binding position. Further, in the receiving teeth 130, the communication holes 132 communicating with the outside are formed in the respective receiving valleys 130*b* for discharge of air and residual water.

In the example of FIG. 28B, the water supply holes (water supply tubes) 86 are formed in the respective ridges 82*a* of the pressure teeth 82 like the above example, and the communication holes 132 of the receiving teeth 130 are cut larger into a substantially square shape in cross section. This allows effective discharge of air and residual water.

In the example of FIG. 28C, the water supply holes (water supply tubes) 86 are formed in the respective ridges 82*a* of the pressure teeth 82 like the above examples, and the communication holes 132 are formed in the respective receiving ridges 130*a* of the receiving teeth 130. This increases the mating accuracy to increase the crimping force and allows discharge of air and water.

[Modification 3—Installation of Extension Tank]

Figure 29A:
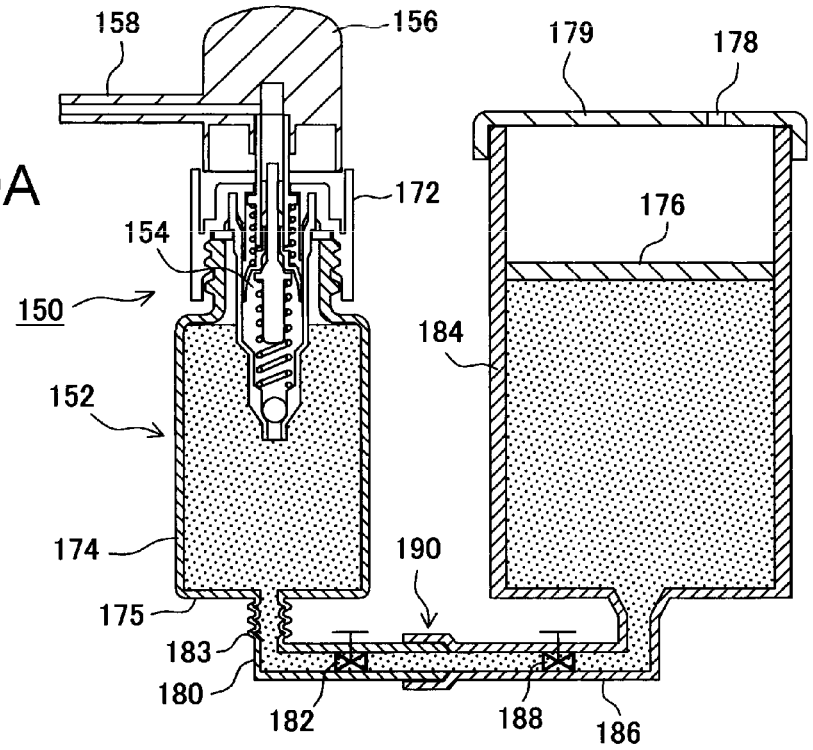
Figure 29B:
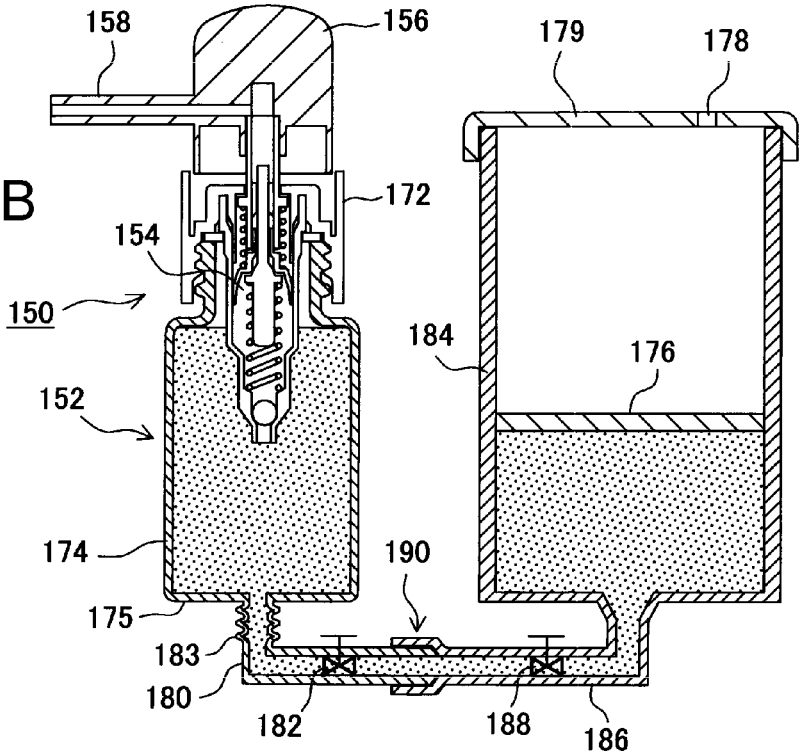

FIGS. 29A and 29B are explanatory views illustrating a configuration in which an extension tank 184 for increasing the capacity of the water replenishment tank 174 of the water replenishment tank part 152 of FIG. 10 is additionally installed. FIG. 29A illustrates a state where the extension tank 184 is substantially filled with water, and FIG. 29B illustrates a state where the amount of water in the extension tank 184 is reduced.

As illustrated, a connection pipe 180 of the water replenishment tank 174 and an extension pipe 186 of the extension tank 184 are connected at a connection part 190. Thus, when the amount of water in the water replenishment tank 174 is reduced, water can be supplied to the water replenishment tank 174 through the connection pipe 180 and the extension pipe 186.

A tank manual valve 182 for stopping or releasing the water flow is provided in the connection pipe 180, and an extension tank manual valve 188 having the same function as that of the tank manual valve 182 is provided in the extension pipe 186. Thus, the extension tank 184 can be separated from the water replenishment tank 174 as needed for water replenishment.

Further, a bellows part 183 is provided at the entrance of the connection pipe 180 fitted to the bottom of the water replenishment tank 174 so as to allow vertical movement of the water replenishment pump unit 150, enabling operation of the water replenishment piston part 154 in the binding unit 60. In this case, the moving plate 176 vertically moved with a reduction in the amount of water is provided in the extension tank 184, and the air hole 178 described above is formed in an upper lid 179. Thus, according to the modification 3, water application can be performed more frequently without increasing the capacity of the water replenishment pump unit 150. Further, the extension tank 184 can be separated from the water replenishment tank 174, thus facilitating water replenishment operation.

It should be appreciated that the present invention is not limited to the above embodiment, and various modifications may be made. Further, all technical matters included in the technical ideas set forth in the claims should be covered by the present invention. While the invention has been described based on a preferred embodiment, various substitutions, corrections, modifications, or improvements may be made from the content disclosed in the specification by a person skilled in the art, which are included in the scope defined by the appended claims.

What is claimed is:

1. A binding unit that crimp-binds placed sheets, comprising:

a pair of first and second pressurizing parts disposed on front and back sides of placed sheets and configured to crimp-bind the placed sheets;

a water reservoir provided on a back side of the first pressurizing part and configured to store water to be applied to the sheets; and a pressurizing member that pressurizes the water in the water reservoir to apply the water to a sheet crimping range, wherein the pair of first and second pressurizing parts includes first pressure teeth and second pressure teeth that crimp-bind the sheets interposed therebetween, and the water reservoir and the pressurizing member are provided on the back side of the first pressure teeth.

2. The binding unit according to claim 1, wherein the water reservoir is a cylinder, and the pressurizing member is a piston to be inserted into the cylinder for pressurization.

3. The binding unit according to claim 2, wherein a cylinder guide to be inserted into the cylinder provided on the back side of the first pressure teeth together with the piston is provided radially outside the piston.

4. The binding unit according to claim 3, wherein the cylinder positioned on the back side of the first pressure teeth is formed integrally with the first pressure teeth and has a replenishment port through which the water reservoir is replenished with water to be stored in the water reservoir.

5. The binding unit according to claim 4, wherein when water is stored in the water reservoir, pressurization of the piston applies water and then presses the first pressure teeth to crimp the sheets; while when no water is stored in the water reservoir, pressurization of the piston applies the first pressure teeth without applying water.

6. The binding unit according to claim 5, wherein an elastic body that crimps the sheets together with the first pressure teeth and surrounds an area larger than an area where the first pressure teeth contact the sheets and a water application range by the pressurizing member is provided around the first pressure teeth.

7. The binding unit according to claim 6, wherein the first pressure teeth have, on a front side thereof, the elastic body that surrounds the first pressure teeth and are brought into pressure contact with the sheets by an elastic spring provided at a side of the cylinder on the back side of the first pressure teeth so as to press the elastic body to the sheets and then applies water in the water reservoir to the sheets.

8. The binding unit according to claim 7, wherein water supply holes allowing water from the water reservoir to be applied to a range surrounded by the elastic body are provided.

9. A binding that crimp-binds placed sheets, comprising:

a pair of first and second pressurizing parts disposed on front and back sides of placed sheets and configured to crimp-bind the placed sheets;

a water reservoir provided on a back side of the first pressurizing part and configured to store water to be applied to the sheets; and a pressurizing member that pressurizes the water in the water reservoir to apply the water to a sheet crimping range, wherein a water replenishment pump part that replenishes the water reservoir with water is provided in a frame in which a first pressure teeth and the water reservoir provided on a back side of the first pressure teeth are positioned so as to be adjacent to the first pressure teeth and the water reservoir, and the water replenishment pump part includes a water replenishment tank part that stores water for replenishment, a water replenishment piston part that supplies water from the water replenishment tank part, a water replenishment head part that moves the water replenishment piston part, and a water replenishment joint part that joints the water replenishment tank part and the water reservoir and replenishes the water reservoir provided on the back side of the first pressure teeth with water.

10. The binding unit according to claim 9, wherein a pressurizing piston and the water replenishment head part are moved by moving members, respectively, and the moving members are driven by a single drive motor.

11. The binding unit according to claim 10, wherein the moving members include a pressing plate that moves the piston and the water replenishment head part and a turning arm turned about a turning fulcrum mounted to the frame, the turning arm causing the pressing plate to move to press the piston and the replenishment head part.

12. The binding unit according to claim 11, wherein a drain pan that receives residual water generated when water in the water reservoir is applied to the sheets is provided on a back side of the second pressure teeth mating with the first pressure teeth.

13. A binding unit that crimp-binds placed sheets, comprising:

a pair of first and second pressurizing parts disposed on front and back sides of placed sheets and configured to crimp-bind the placed sheets;

a water reservoir provided on a back side of the first pressurizing part and configured to store water to be applied to the sheets; and a pressurizing member that pressurizes the water in the water reservoir to apply the water to a sheet crimping range, wherein the pair of first and second pressurizing parts includes first pressure teeth and second pressure teeth that crimp-bind the sheets interposed therebetween, and the water reservoir is a cylinder, and the pressurizing member is a piston to be inserted into the cylinder for pressurization.

14. The binding unit according to claim 13, wherein the water reservoir and the pressurizing member are provided on a back side of the first pressure teeth.

* * * * *